US007815985B2

(12) United States Patent
Yoshino

(10) Patent No.: US 7,815,985 B2
(45) Date of Patent: Oct. 19, 2010

(54) RECORDING MEDIUM, PRODUCTION PROCESS OF THE RECORDING MEDIUM AND IMAGE FORMING PROCESS USING THE RECORDING MEDIUM

(75) Inventor: Hitoshi Yoshino, Zama (JP)

(73) Assignee: Canon Kabushiki Kaisha, Tokyo (JP)

( * ) Notice: Subject to any disclaimer, the term of this patent is extended or adjusted under 35 U.S.C. 154(b) by 955 days.

(21) Appl. No.: 11/281,473

(22) Filed: Nov. 18, 2005

(65) Prior Publication Data

US 2006/0078697 A1 Apr. 13, 2006

Related U.S. Application Data

(63) Continuation of application No. PCT/JP2005/010455, filed on Jun. 1, 2005.

(30) Foreign Application Priority Data

Jun. 1, 2004 (JP) ..... 2004-163672

(51) Int. Cl.
*B41M 5/40* (2006.01)

(52) U.S. Cl. ..... 428/32.34; 428/32.21; 428/32.25

(58) Field of Classification Search ..... None
See application file for complete search history.

(56) References Cited

U.S. PATENT DOCUMENTS

| | | | | |
|---|---|---|---|---|
| 4,269,891 | A | 5/1981 | Minagawa | 428/335 |
| 5,213,873 | A | 5/1993 | Yasuda et al. | 428/195 |
| 5,635,291 | A | 6/1997 | Yoshino et al. | 428/304.4 |
| 5,679,451 | A | 10/1997 | Kondo et al. | 428/304.4 |
| 5,707,716 | A | 1/1998 | Yoshino et al. | 428/212 |
| 5,738,932 | A | 4/1998 | Kondo et al. | 428/195 |
| 5,800,916 | A | 9/1998 | Yoshino et al. | 428/328 |
| 5,804,320 | A | 9/1998 | Tomioka et al. | 428/478.2 |
| 5,846,647 | A | 12/1998 | Yoshino et al. | 428/328 |
| 5,851,654 | A | 12/1998 | Yoshino et al. | 428/328 |
| 5,869,177 | A | 2/1999 | Yoshino et al. | 428/328 |
| 5,955,142 | A | 9/1999 | Yoshino et al. | 427/205 |
| 5,955,185 | A | 9/1999 | Yoshino et al. | 428/304.4 |
| 5,962,124 | A | 10/1999 | Yoshino et al. | 428/328 |

(Continued)

FOREIGN PATENT DOCUMENTS

JP 54-59936 5/1979

(Continued)

*Primary Examiner*—D. Lawrence Tarazano
*Assistant Examiner*—Gregory Clark
(74) *Attorney, Agent, or Firm*—Fitzpatrick, Cella, Harper & Scinto

(57) ABSTRACT

The invention provides a recording medium that prevents ink overflowing even when printing is conducted in an ink quantity exceeding 100%, permits forming an image high in density and bright in color tone and can settle the cause of the occurrence of curling or cockling, a production process of the recording medium, a substrate for the recording medium and a production process of the substrate. The recording medium comprising a substrate and an ink-receiving layer formed on the substrate, wherein the substrate is composed mainly of a fibrous material and has, at a position adjacent to the ink-receiving layer in the substrate, a surface coated part region in a state that the surface of the fibrous material has been coated with an alumina hydrate, and the ink-receiving layer comprises a porous inorganic pigment as a principal component, and a production process of the recording medium.

12 Claims, 8 Drawing Sheets

U.S. PATENT DOCUMENTS

| | | | | |
|---|---|---|---|---|
| 5,985,076 | A | 11/1999 | Misuda et al. | 156/230 |
| 6,000,794 | A | 12/1999 | Kondo et al. | 347/105 |
| 6,177,188 | B1 | 1/2001 | Ichioka et al. | 428/342 |
| 6,342,289 | B1 | 1/2002 | Eguchi et al. | 428/195 |
| 6,391,440 | B1 | 5/2002 | Yoshino et al. | 428/342 |
| 6,432,517 | B1 * | 8/2002 | Yokota et al. | 428/32.21 |
| 6,576,324 | B2 | 6/2003 | Yoshino et al. | 428/195 |
| 6,649,661 | B2 | 11/2003 | Yoshino et al. | 516/93 |
| 6,706,340 | B2 | 3/2004 | Yoshino et al. | 428/32.21 |
| 6,716,495 | B1 | 4/2004 | Yoshino et al. | 428/31.16 |
| 6,720,041 | B2 | 4/2004 | Yoshino et al. | 428/32.32 |
| 6,945,646 | B2 | 9/2005 | Ogino et al. | 347/105 |
| 7,060,332 | B2 | 6/2006 | Kwon et al. | 428/32.32 |
| 7,060,335 | B2 | 6/2006 | Ichinose | 428/32.21 |
| 7,144,613 | B2 | 12/2006 | Eguchi et al. | 428/32.37 |
| 2006/0078697 | A1 | 4/2006 | Yoshino | 428/32.34 |
| 2007/0013761 | A1 | 1/2007 | Yoshino et al. | 347/105 |
| 2008/0241436 | A1 | 10/2008 | Kobayashi | 428/32.22 |

FOREIGN PATENT DOCUMENTS

| | | | |
|---|---|---|---|
| JP | 55-5830 | | 1/1980 |
| JP | 55-51853 | | 4/1980 |
| JP | 62-55996 | B2 | 11/1987 |
| JP | 63-22997 | B2 | 5/1988 |
| JP | 2-270588 | | 11/1990 |
| JP | 3-38376 | | 2/1991 |
| JP | 3-199081 | | 8/1991 |
| JP | 6-312572 | | 11/1994 |
| JP | 7-276786 | | 10/1995 |
| JP | 8-72388 | | 3/1996 |
| JP | 8-300809 | | 11/1996 |
| JP | 9-99627 | | 4/1997 |
| JP | 10-46498 | | 2/1998 |
| JP | 2714350 | B2 | 2/1998 |
| JP | 2714351 | B2 | 2/1998 |
| JP | 2714352 | B2 | 2/1998 |
| JP | 2000-158805 | | 6/2000 |
| JP | 2000-211250 | | 8/2000 |
| JP | 2001-246840 | | 9/2001 |
| JP | 2001-253160 | | 9/2001 |
| JP | 2002-2092 | | 1/2002 |
| JP | 2002-154268 | | 5/2002 |
| JP | 2002-201597 | | 7/2002 |
| JP | 2002-211121 | | 7/2002 |
| JP | 2002-327353 | | 11/2002 |

* cited by examiner

RECORDING MEDIUM, PRODUCTION PROCESS OF THE RECORDING MEDIUM AND IMAGE FORMING PROCESS USING THE RECORDING MEDIUM

This application is a continuation of International Application No. PCT/JP2005/010455, filed on Jun. 1, 2005, which claims the benefit of Japanese Patent Application No. 2004-163672 filed on Jun. 1, 2004.

BACKGROUND OF THE INVENTION

1. Field of the Invention

The present invention relates to a recording medium, a substrate for a recording medium, production processes thereof, and an image forming process using the recording medium. In particular, the present invention relates to a recording medium, which can provide a clear or bright and high-quality recorded image in a surface coated part region thereof and can prevent the occurrence of a phenomenon called cockling in which a printed surface is waved by an aqueous ink, and a production process of the recording medium.

2. Related Background Art

An ink-jet recording system often used in recent years is a system in which fine droplets of an ink are flown by any one of various working principles to apply them to a recording medium such as paper, thereby making a record of images, characters and/or the like. Recording apparatus, to which this recording system is applied, are quickly spread as recording apparatus for various images in various applications including information instruments because they have features that recording can be conducted at high speed and with a low noise, multi-color images can be formed with ease, printing patterns are very flexible, and neither development nor fixing is unnecessary. Further, they begin to be widely applied to a field of recording of full-color images because images formed by a multi-color ink-jet system are comparable in quality with multi-color prints by a plate making system and photoprints by a color photographic system, and such images can be obtained at lower cost than the usual multi-color prints and photoprints when the number of copies is small.

With the enlarged utilization of the ink-jet recording system, further improvements in recording properties such as speeding up and high definition of recording, and full-coloring of images are required, so that recording apparatus and recording methods are improved. In order to meet such requirements, a wide variety of recording media have heretofore been proposed. For example, there have been proposed paper for ink-jet recording, in which a coating layer having good ink absorbency is provided on a surface of a substrate (for example, Japanese Patent Application Laid-Open No. S55-5830), and the use of amorphous silica as a pigment in an ink-receiving layer laminated on a substrate for recording medium (for example, Japanese Patent Application Laid-Open No. S55-51583).

With the diversification of uses, it has also been required to reduce the occurrence of curling or cockling of printed articles for the purpose of improving the quality of recorded images. These phenomena are both considered to be caused due to the occurrence of expansion or shrinkage and distortion on a recording medium by absorption of an ink. In the present invention, the cockling means a phenomenon that a printed surface of a recording medium is made irregular or waved. As means for avoiding this cockling phenomenon, there have heretofore been proposed the following methods.

(1) Japanese Patent Application Laid-Open Nos. H3-38376, H3-199081, H7-276786 and H8-300809 describe recording media using paper having an underwater elongation and a wetted elongation within respective specified ranges. However, since the technical ideas described in these documents are based on the premise that water is evenly given to the whole of a recording medium, they cannot cope with a case where states applied with a liquid differ with portions.

(2) Japanese Patent Application Laid-Open No. H10-46498 discloses a crosslinking treatment in which a water-proofing agent, a polymer, a size and the like are used to form a bound structure between fibers, and also discloses to the effect that the degree of floating after 10 seconds from printing is controlled to 1 mm or small. Japanese Patent Application Laid-Open No. 2002-201597 has proposed a recording medium in which cellulose fiber is shrunk by a mercerization treatment that a treatment with an alkali is conducted on the whole surface, and discloses to the effect that friction with an ink-jet recording head is avoided. Incidentally, these proposals are both those for recording media on which no ink-receiving layer is provided.

(3) The constitution that an ink-receptive layer containing a water-repellent component in Japanese Patent Application Laid-Open No. 2000-158805 and a void layer formed of a thermoplastic resin such as polyurethane in Japanese Patent Application Laid-Open No. 2002-154268 are respectively provided as intermediate layers for barrier preventing penetration of inks between an ink-receiving layer and a substrate is described. Since these intermediate layers both act as a barrier preventing penetration of inks, the quantity of inks absorbed is reduced, and an ink-absorbing speed is lowered when the quantity of inks printed is great because the inks printed do not penetrate into the substrate, so that ink overflowing and/or bleeding may be caused in some cases.

(4) Proposals for the solution, which are different from the methods in the above-described publicly known documents, include the following proposals. Namely, the proposals comprise providing an additional structure on a recording medium. A recording medium, in which ink-receptive layers are provided on both surfaces of a substrate, a recording medium, in which a back coat layer is provided on a surface opposite to an ink-receiving layer, and a recording medium, in which substrates are laminated on each other into a two-layer structure, are described in Japanese Patent Application Laid-Open Nos. H2-270588, 2001-253160 and 2002-2092, respectively.

(5) On the other hand, Japanese Patent Application Laid-Open No. 2002-211121 discloses a recording medium, in which an aqueous solution containing a cationic resin and an alumina hydrate is coated on an ink-receiving surface of a single-layer fibrous structure composed mainly of a fibrous material containing no filler and making no use of a size (non-sized). It is described that according to the structure disclosed in this document, the cationic resin and alumina hydrate can be caused to exist on the surface of the fibrous material, thereby surely trapping an anionic colorant, so that an excellent image can be formed without causing cockling and very great curling upon formation of a 100% solid-printed image.

(6) Japanese Patent Application Laid-Open No. 2001-246840 discloses a recording medium, in which an ink-receiving layer having an inorganic pigment and a binder is formed in a coating weight of 1 to 10 g/m$^2$ on a base material composed mainly of pulp fiber. In Comparative Example 2, it is described that when an ink-receiving layer containing no binder was formed on a base material subjected to a sizing treatment, an alumina hydrate that is an inorganic pigment entered pulp fiber, and the surface of the pulp was scarcely coated with the alumina hydrate.

The present inventors have carried out an investigation on various kinds of the recording media proposed in the prior art documents mentioned above and found, on all the recording media, a phenomenon that new cockling or curling is caused when printing is conducted in an ink quantity exceeding 100% in particular. When the state thereof has been analyzed, it has been found that the number of portions undergoing cockling substantially increases, so that the cockling is conspicuous. The present inventors have also found that when a quantity of an ink applied to a recording medium is increased to 2 times or 3 times to form an image, the ink-absorbing capacity of the recording medium itself is lowered, so that ink overflowing and/or bleeding may be caused in some cases to fail to achieve good image quality.

The present inventors have paid attention to the fibrous materials of the substrates to carry out research and investigation. As a result, the following facts have been confirmed. Since the alumina hydrate and cationic resin are coated on the fibrous material by on-machine coating in Japanese Patent Application Laid-Open No. 2002-211121, the alumina hydrate is limited by the application of the cationic resin to the surface of the fibrous material and partially scattered. It has been confirmed that the cockling-inhibiting effect by the alumina hydrate is not sufficiently brought about on the recording medium disclosed in this document as described below.

In Japanese Patent Application Laid-Open No. 2001-246840, the substrate containing pulp and a filler and size-pressed is used. Accordingly, when the alumina hydrate is applied without using a binder like Comparative Example 2 of this document, the alumina hydrate cannot be applied to the surface of the substrate fiber, but only fills in voids formed by the pulp. It has been thus confirmed that this constitution does not bring about the cockling-inhibiting effect as described below.

As described above, it has been confirmed that when images are formed by printers for conducting high-speed printing in recent years, or the like, even the various kinds of recording media proposed in the prior art documents are not always satisfied from the viewpoints of image quality, curling, cockling, conveyability and the like.

It is a principal object of the present invention to solve the novel problems on the basis of such new findings.

The present inventors have sought a phenomenon by deformation of fiber, such as swelling and elongation, that is a cockling producing mechanism and considered that it is caused by excessive absorption of water by the fiber and a high degree of freedom of displacement within an allowable space. Accordingly, the present inventors have sought means that a water-holding capacity of the fiber itself can be diffused so as to be optimized, and at the same time the degree of freedom of displacement can also be controlled, thus leading to completion of the present invention.

It is thus a first object of the present invention to provide a recording medium having an ink-receiving layer that can solve the above-described new problem caused by conducting printing in an ink quantity exceeding 100%, permits forming an image high in density and bright in color tone and can settle the cause of the occurrence of new curling or cockling, and a production process of the recording medium.

A second object of the present invention is to provide a substrate (including a case where the substrate itself functions as an ink-receiving layer) for a recording medium for preventing ink overflowing even in an ink quantity exceeding 100%, permitting forming an image high in density and bright in color tone and settling the cause of the occurrence of new curling or cockling, and a production process of the substrate for a recording medium.

The above objects can be achieved by the present invention described below.

SUMMARY OF THE INVENTION

In a first aspect of the present invention, there is provided a recording medium comprising a substrate and an ink-receiving layer formed on the substrate, wherein the substrate is composed mainly of a fibrous material and has, at a position adjacent to the ink-receiving layer in the substrate, a surface coated part region in a state that the surface of the fibrous material has been coated with alumina hydrate aggregate, and the ink-receiving layer comprises a porous inorganic pigment as a principal component.

In this recording medium, a range, in which the surface coated part region exists in a thickness-wise direction of the substrate, may preferably be at least 20 μm, and the alumina hydrate aggregate in the surface coated part region may preferably adhere to the surface of the fibrous material and be in a state that voids formed by the fibrous material have been left without being closed. In particular, in addition to this, the alumina hydrate aggregate may preferably fill in fine interspaces that are formed by the fibrous material intersected with or approached to each other and far smaller than the voids. In the recording medium, the porous inorganic pigment may preferably be at least one selected from among porous silica, porous calcium carbonate, porous magnesium carbonate and an alumina hydrate, and the alumina hydrate may preferably be that having a boehmite structure. More specifically, the quantity of the alumina hydrate applied to the substrate may preferably be 0.5 $g/m^2$ to 4 $g/m^2$ per one surface, and the alumina hydrate may preferably be applied to the fibrous material by on-machine coating.

In a second aspect of the present invention, there is provided a process for producing the recording medium described above, which comprises the steps of applying alumina hydrate aggregate to one surface of a substrate composed mainly of a fibrous material to form a surface coated part region that at least the surface of the fibrous material is coated with the alumina hydrate aggregate, and applying an aqueous dispersion of a porous inorganic pigment on to the surface coated part region and drying it to form an ink-receiving layer. In the production process, a coating liquid comprising the porous inorganic pigment and a binder as principal components may preferably be applied in the step of forming the ink-receiving layer so as to give a coating weight of from 5 $g/m^2$ to 30 $g/m^2$ in terms of dry solid content. In the production process, base paper of a single-layer fibrous structure composed mainly of a fibrous material containing no filler and subjected to no surface sizing treatment (non-sized) may preferably be used as the substrate.

In a third aspect of the present invention, there is provided a substrate for a recording medium used upon the production of a recording medium having an ink-receiving layer, which mainly comprises a fibrous material and has a surface coated part region in which the surface of the fibrous material is coated with alumina hydrate aggregate.

In the substrate, a range, in which the surface coated part region exists in a thickness-wise direction of the substrate, may preferably be at least 20 μm. The alumina hydrate aggregate in the surface coated part region may preferably adhere to the surface of the fibrous material and be in a state that voids formed by the fibrous material have been left without being closed. In particular, in addition to this, the alumina hydrate aggregate may preferably fill in fine interspaces that are formed by the fibrous material intersected with or approached to each other and far smaller than the voids.

In a fourth aspect of the present invention, a process for producing the above-described substrate for a recording medium, which comprises the step of applying a solution containing alumina hydrate aggregate and containing neither a cationic resin nor a binder for forming the surface coated part region to substrate base paper subjected to no surface sizing treatment. In the production process, base paper of a single-layer fibrous structure composed mainly of a fibrous material containing no filler and making no use of a size (non-sized) may preferably be used as the substrate.

In a fifth aspect of the present invention, there is provided a recording medium composed mainly of a fibrous material, to which ink droplets are directly applied (namely, on which no ink-receiving layer is formed), wherein the recording medium has a surface coated part region in a state that the surface of the fibrous material has been coated with alumina hydrate aggregate. In this recording medium, a range, in which the surface coated part region exists in a thickness-wise direction of the substrate, may preferably be at least 20 μm, and the alumina hydrate aggregate in the surface coated part region may preferably adhere to the surface of the fibrous material and be in a state that voids formed by the fibrous material have been left without being closed. In particular, in addition to this, the alumina hydrate aggregate may preferably fill in fine interspaces that are formed by the fibrous material intersected with or approached to each other and far smaller than the voids.

In a sixth aspect of the present invention, there is provided a process for producing the recording medium described above, which comprises the step of applying a solution containing an alumina hydrate and containing neither a binder nor a cationic resin for forming the surface coated part region to a fibrous material subjected to no surface sizing treatment.

In the production process, base paper of a single-layer fibrous structure composed mainly of a fibrous material containing no filler and making no use of a size (non-sized) may preferably be used as the substrate.

In a further aspect of the present invention, there is provided an image forming process comprising the step of applying an ink to any one of the recording media described above to conduct printing. In this process, the application of droplets of the ink to the recording medium may preferably be conducted by an ink-jet method that fine droplets of an ink are ejected from minute orifices to apply them to the recording medium, or a method that ejection of the droplets of the ink is conducted by applying thermal energy to the ink.

Typical effects brought about by the invention described above are as follows.

(1) According to the first aspect of the present invention, additional occurrence of curling and cockling after the printing is little even when the printing is conducted in an ink quantity exceeding 100% in the case where the thickness of the substrate and ink-receiving layer is relatively thin (for example, at most 10 g/m$^2$), ink absorbency becomes better, and no strike-through is caused.

(2) According to the second aspect of the present invention, the formation of the ink-receiving layer can be conducted at high speed, so that productivity is improved.

(3) According to the third aspect of the present invention, a substrate having good ink absorbency can be provided even when the thickness of the ink-receiving layer is thin. Even when printing is conducted in an ink quantity exceeding 100%, the surface profile of the fiber and the size of voids among the fibers are made even because the surface of the fiber is coated with the alumina hydrate, so that an ink can be evenly diffused, and the occurrence of uneven expansion or elongation of a printed area can be prevented to reduce cockling.

(4) According to the fourth aspect of the present invention, a substrate having good ink absorbency can be provided because no surface sizing treatment is conducted. Further, the alumina hydrate dispersion liquid containing no binder is applied, whereby the fiber surface can be coated with the alumina hydrate while retaining the voids among the fibers. As a result, an ink can be evenly diffused, and the occurrence of uneven expansion or elongation of a printed area can be prevented to reduce cockling. In the production process of the present invention, the on-machine coating can be carried out, so that productivity can be made high.

(5) According to the fifth aspect of the present invention, the recording medium is composed mainly of a fibrous material, and the fibrous material is coated with the alumina hydrate in the vicinity of at least the surface thereof, so that the ink absorbency and resistance to curling are improved.

(6) According to the sixth aspect of the present invention, the on-machine coating can be carried out in the production process of the present invention, so that productivity can be made high.

BRIEF DESCRIPTION OF THE DRAWINGS

FIG. 2EB is an enlarged electron microphotograph (100, 000 magnifications) of a portion surrounded by a line 2.5.2 in the electron microphotograph in FIG. 2E.

FIG. 2EC is an enlarged electron microphotograph (100, 000 magnifications) of a portion surrounded by a line 2.5.3 in the electron microphotograph in FIG. 2E.

DETAILED DESCRIPTION OF THE PREFERRED EMBODIMENTS

The present invention will hereinafter be described in more detail by preferred embodiments. The present inventors have carried out various investigations as to deformation of a substrate and an ink-receiving layer by shooting of an ink. As a result, it has been found that when an alumina hydrate is caused to exist in a substrate composed of a fibrous material, and an ink-receiving layer comprising a porous inorganic pigment as a principal component is formed on such a substrate, the occurrence of cockling can be reduced when printing is conducted in an ink quantity exceeding 100% in particular, thus leading to completion of the present invention. It has been further found that a recording medium, by which the occurrence of cockling can be reduced, can be provided by a process that an aqueous dispersion comprising a porous inorganic pigment as a principal component is applied to a substrate composed of a fibrous material, in which an alumina hydrate has been caused to exist, and dried, thereby forming an ink-receiving layer.

Figure 1:
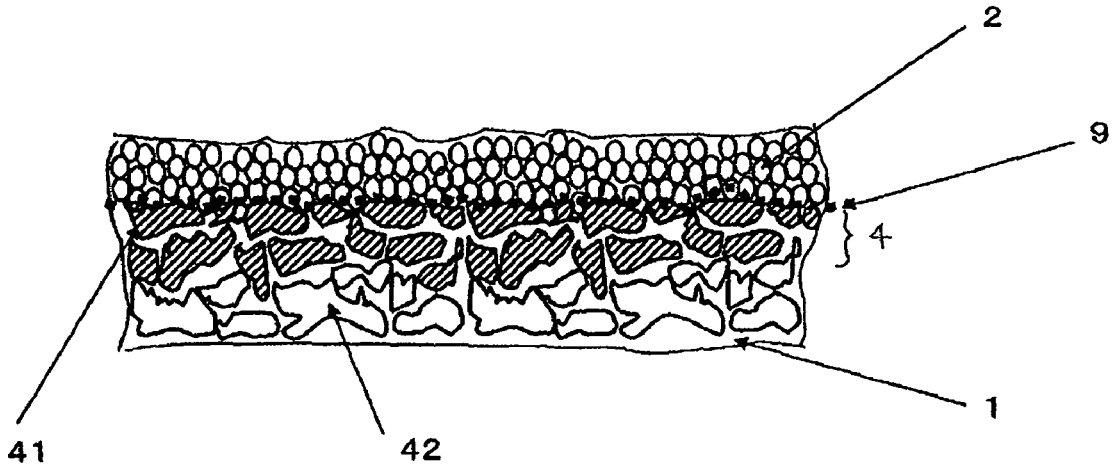
FIG. 1 is a cross-sectional view of a recording medium according to the present invention.

FIG. 1 is a schematic cross-sectional view illustrating an exemplary recording medium according to the present invention. As illustrated in FIG. 1, this recording medium has a structure that a porous ink-receiving layer 2 (hereinafter referred to as "ink-receiving layer") is formed on a substrate 1. A boundary portion 9 is present at a boundary between the substrate 1 and the ink-receiving layer 2. The recording medium has a structure that both substrate and ink-receiving layer are clearly separated from each other. A fibrous material making up the substrate 1 has a region (surface coated part region 4) in a state (41) that the surface of the fibrous material has been coated with alumina hydrate aggregate in the vicinity of the boundary portion 9, i.e., a position adjacent to the ink-receiving layer 2 in the substrate 1. This surface coated part region 4 may extend over the substrate. In the embodiment illustrated in FIG. 1, however, a lower layer (a side opposed to the ink-receiving layer 2, i.e., a back-surface side) than the surface coated part region 4 of the substrate 1 is in a state (42) that the fibrous material is not coated with the alumina hydrate. The present invention is not limited to the embodiment illustrated so far as the surface coated part region exists in at least a position adjacent to the ink-receiving layer in the substrate. A range, in which the surface coated part region 4 exists in a thickness-wise direction of the substrate, may be suitably preset according to the end application of the recording medium. However, at least 20 μm or so may satisfy as an index that the effect of the present invention can be brought about with still higher certainty.

The present invention will hereinafter be described with reference to photographs of a substrate formed by being impregnated with a liquid with an alumina hydrate having an average particle size of 30 nm dispersed in water alone.

Figure 2:
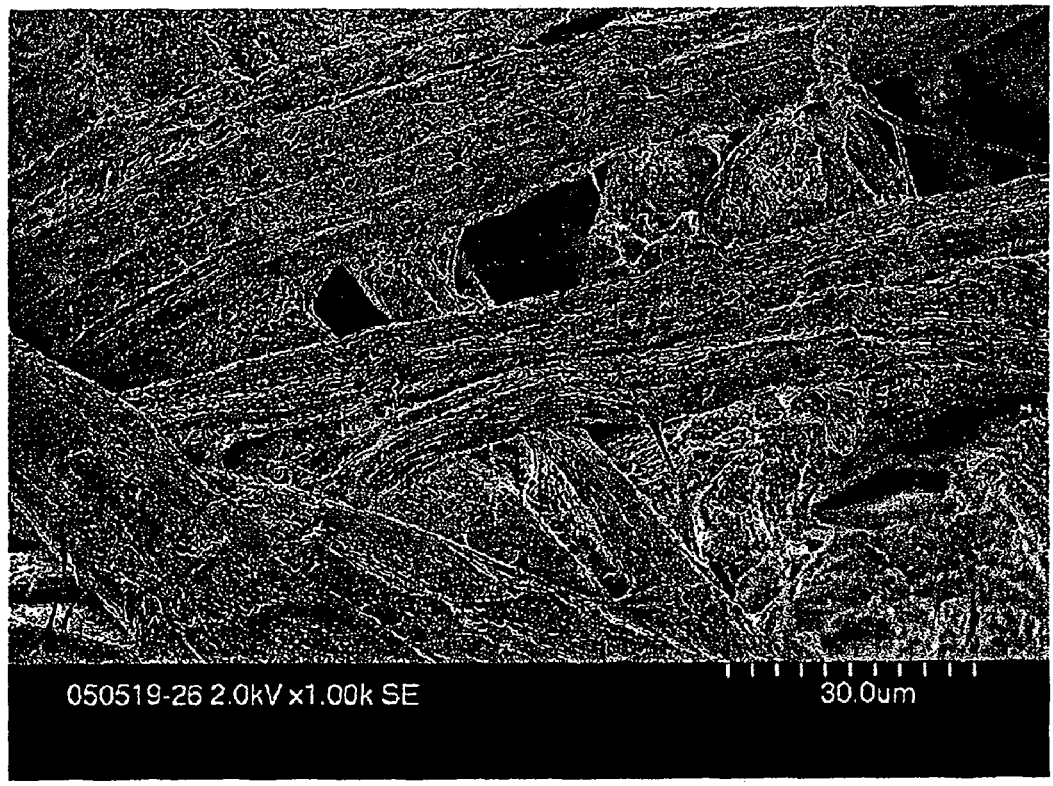
FIG. 2 is an electron microphotograph (1,000 magnifications) of a surface of a substrate 1 of a recording medium according to the present invention.
Figure 3:
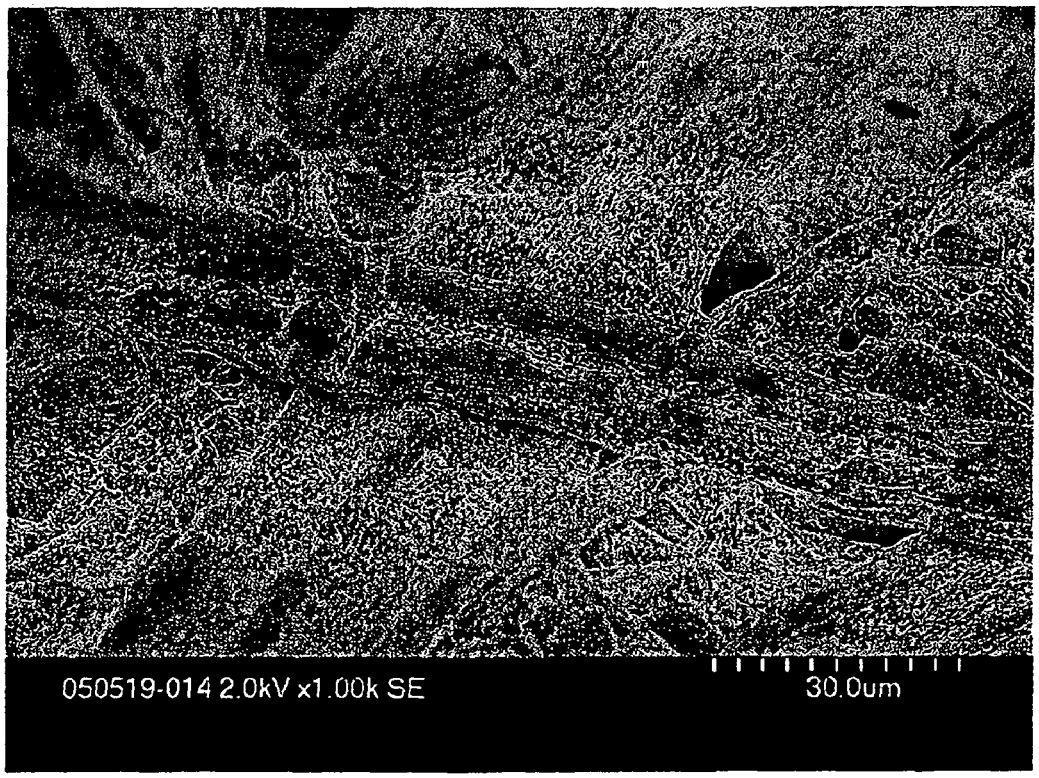
FIG. 3 is an electron microphotograph (1,000 magnifications) of another surface of the substrate 1 of the recording medium according to the present invention.

FIGS. 2 and 3 are electron microphotographs obtained by respectively taking different portions of a surface of a substrate 1 of a recording medium according to the present invention at 1,000 magnifications. It is understood from these photographs in a state enlarged to 1,000 magnifications that the alumina hydrate having an average particle size of 30 nm creates various applied, aggregated and deposited states according to the surfaces of fibers so as to cover almost the whole surface of the fibrous material. Voids formed by the fibrous material are left without being closed. In FIG. 2, it is observed that the alumina hydrate is applied in a great amount in a region in which fine interspaces formed by the fibrous material intersected with or approached to each other and far smaller than the voids overlap.

In order to understand the applied condition of the alumina hydrate to the fibrous material, photographs were taken with the magnification further raised.

Figure 2A:
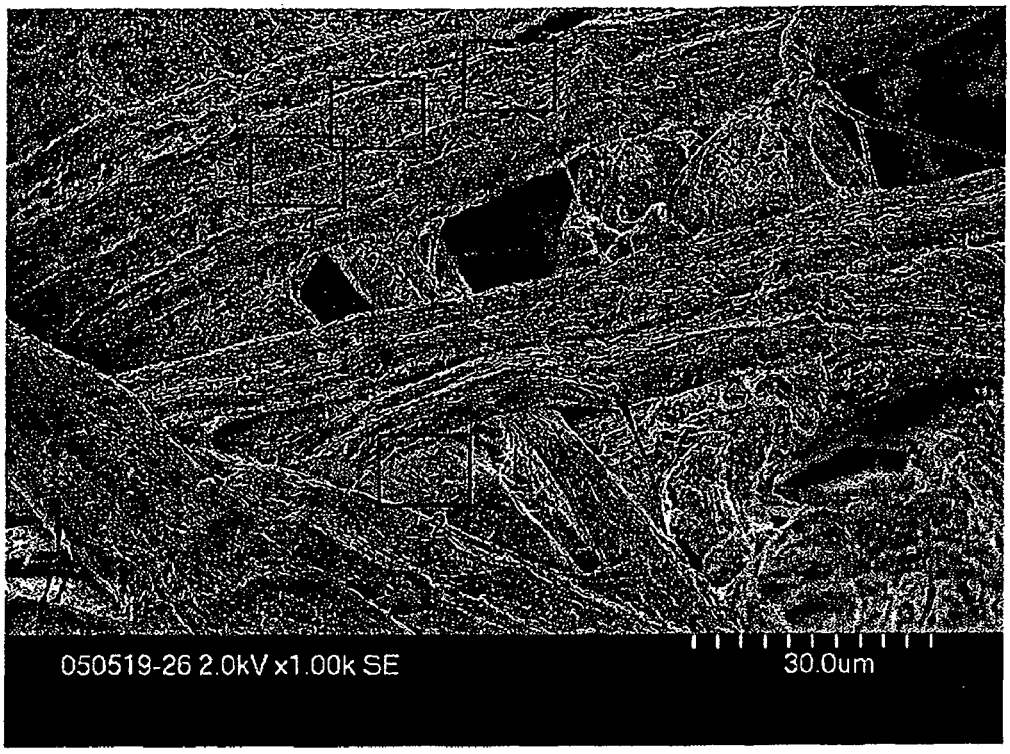
FIG. 2A illustrates an enlarged portion in the electron microphotograph in FIG. 2.
Figure 2B:
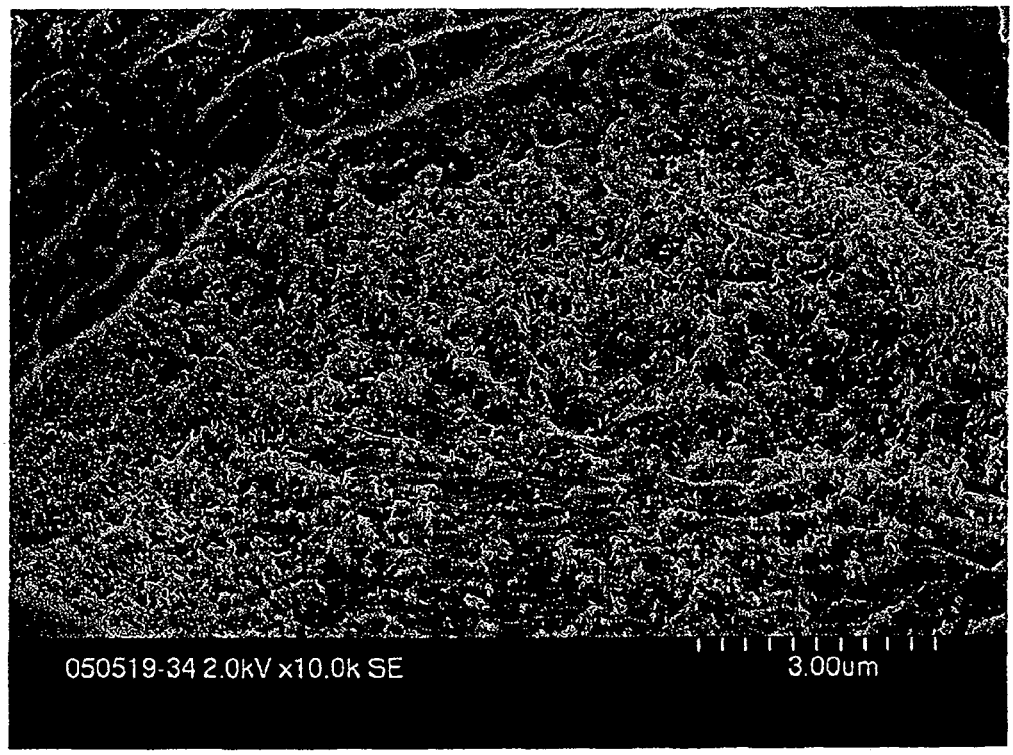
FIG. 2B is an enlarged electron microphotograph (10,000 magnifications) of a portion surrounded by a line 2.2 in the electron microphotograph in FIG. 2A.
Figure 2C:
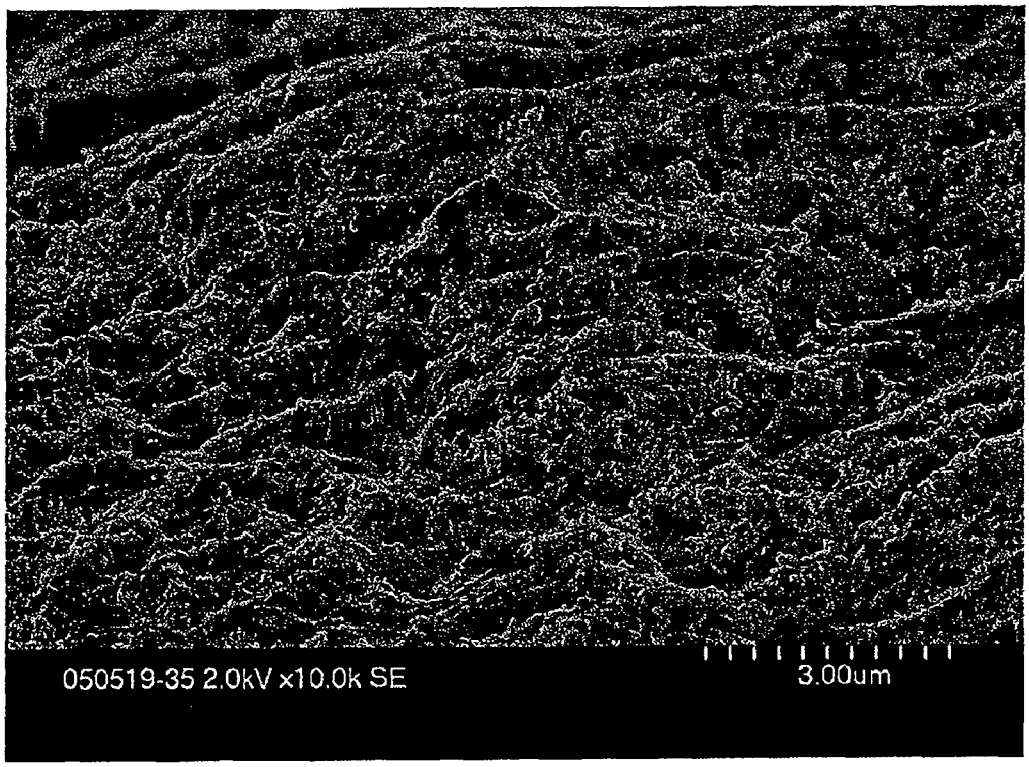
FIG. 2C is an enlarged electron microphotograph (10,000 magnifications) of a portion surrounded by a line 2.3 in the electron microphotograph in FIG. 2A of the surface of the substrate 1 of the recording medium according to the present invention.
Figure 2D:
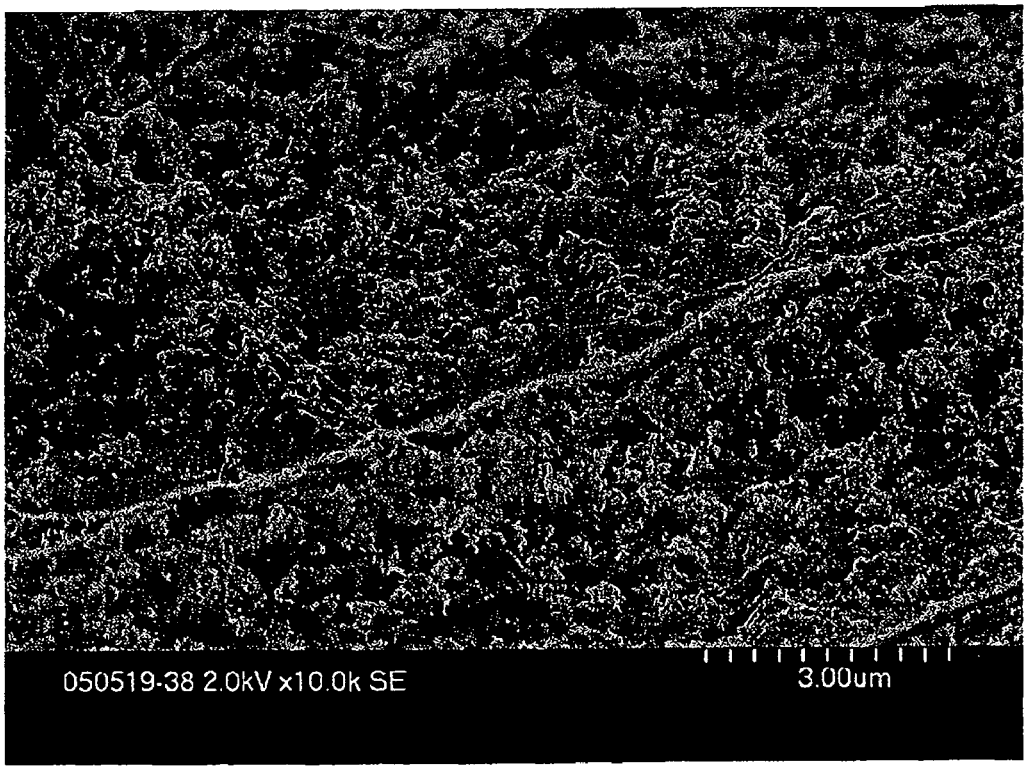
FIG. 2D is an enlarged electron microphotograph (10,000 magnifications) of a portion surrounded by a line 2.4 in the electron microphotograph in FIG. 2A of the surface of the substrate 1 of the recording medium according to the present invention.

FIGS. 2B, 2C, 2D and 2E are electron microphotographs obtained by respectively taking different portions of the surface portion taken in FIG. 2 at 10,000 magnifications. The photographed sites of the respective photographs are indicated in FIG. 2A. It is understood from FIGS. 2B, 2C, 2D and 2E that the fibrous material is coated with the alumina hydrate partially but in an evenly distributed state.

Figure 2E:
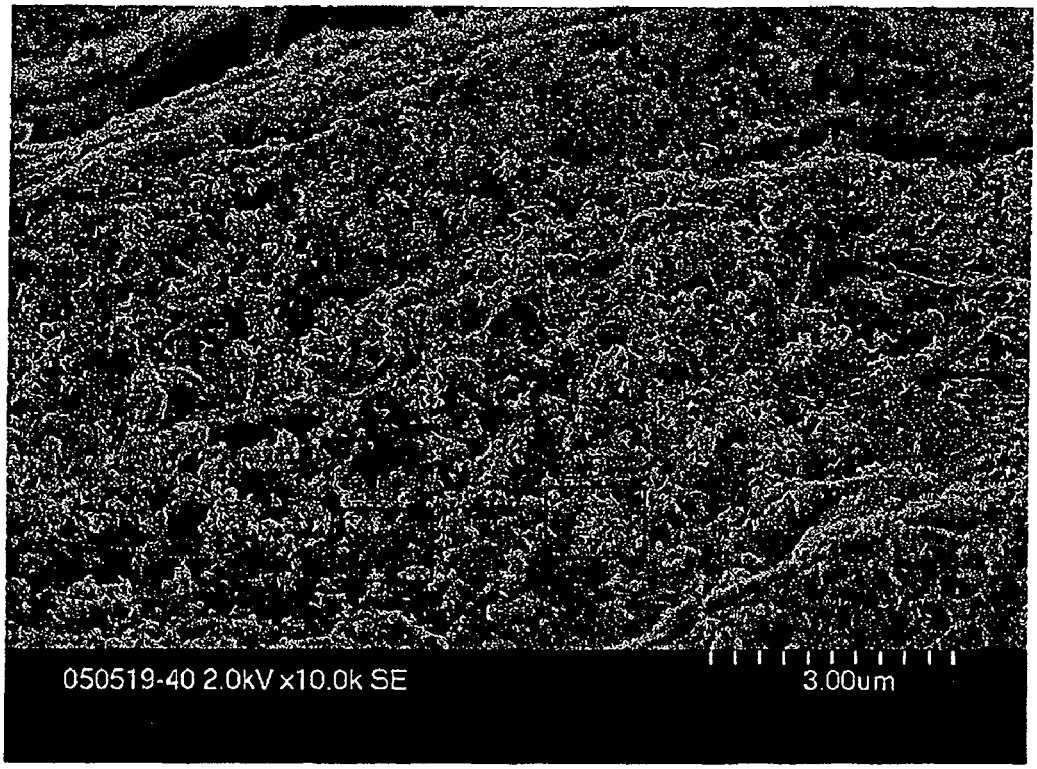
FIG. 2E is an enlarged electron microphotograph (10,000 magnifications) of a portion surrounded by a line 2.5 in the electron microphotograph in FIG. 2A of the surface of the substrate 1 of the recording medium according to the present invention.
Figure 2E:
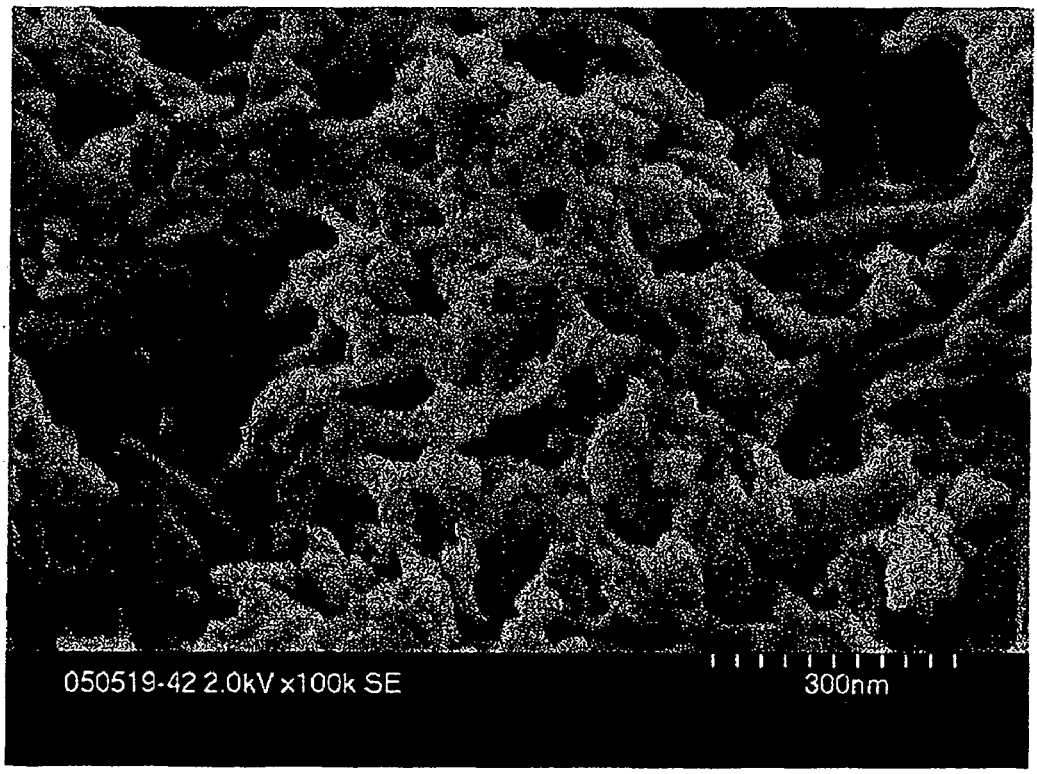
Figure 2E:
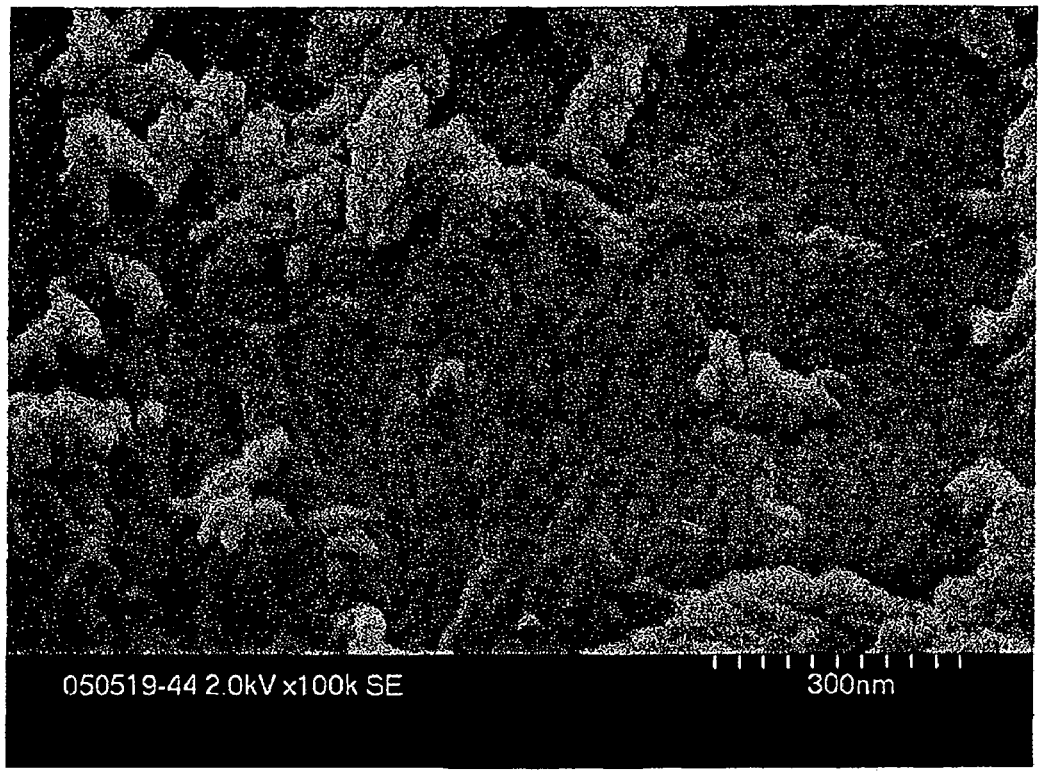

FIGS. 2EB and 2EC are electron microphotographs obtained by respectively taking different portions of the surface portion taken in FIG. 2E at 100,000 magnifications. The photographed sites of the respective photographs are indicated in FIG. 2E. It is understood from FIG. 2EB that the alumina hydrate is applied along directions of fibers in a state that plural particles of the alumina hydrate have aggregated to form aggregate. On the other hand, it is understood from FIG. 2EC that there are sites at which alumina hydrate aggregate further overlaps the alumina hydrate applied along the directions of the fibers to form porous aggregate.

Figure 4:
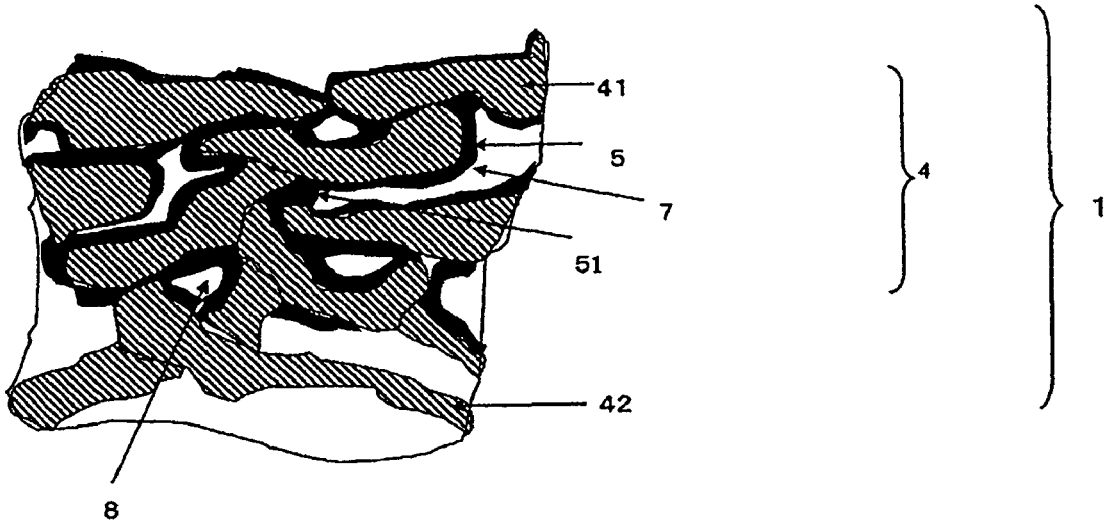
FIG. 4 is a cross-sectional view typically illustrating a substrate of a recording medium according to the present invention.

FIG. 4 typically illustrates an electron microphotograph of a section of a substrate of a recording medium according to the present invention. Large voids 7 and small voids 8 are present between fibers making up the substrate 1. A fibrous material forming these voids is all coated with an alumina hydrate 5 in a surface coated part region 4. As illustrated in FIG. 4, the voids 7 and 8 are spaces formed in a state that the alumina hydrate 5 has been exposed thereto. Incidentally, the term "coated state" as used herein means an almost coated state viewed from an electron microphotograph enlarged to 200 magnifications. It substantially means that the aggregate of the alumina hydrate exists over the surfaces of the fibers while forming pores as understood from the electron microphotographs of 1,000 magnifications or higher. Voids formed by the fibrous material intersected with or approached to each other are left as they are, and an alumina hydrate concentrated portion 51, at which the alumina hydrate 5 is concentrated, is formed in fine interspaces far smaller than the voids. The fine interspaces are preferably in a state filled with the alumina hydrate.

Figure 5:
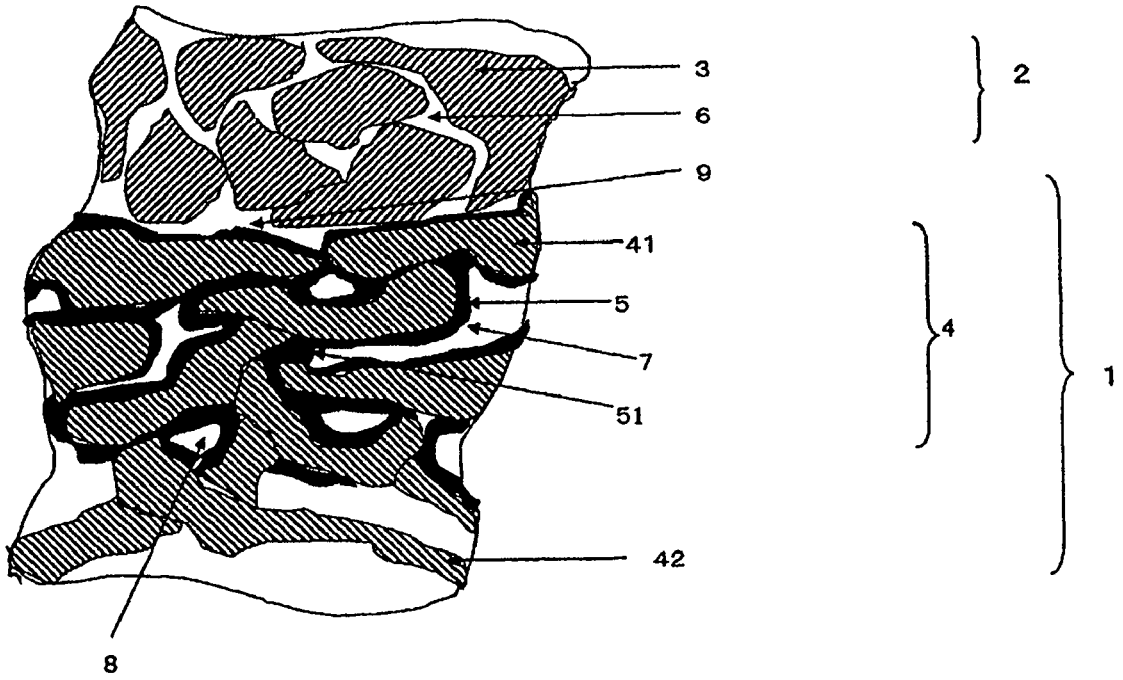
FIG. 5 is a cross-sectional view typically illustrating a boundary portion between the substrate and an ink-receiving layer of the recording medium according to the present invention.

FIG. 5 typically illustrates an electron microphotograph of a section of the recording medium (including a boundary portion 9 between the substrate 1 and an ink-receiving layer 2) according to the present invention. The ink-receiving layer 2 is formed of a porous inorganic pigment 3, and voids 6 are present among particles of the porous inorganic pigment 3. The fibrous material making up the substrate 1 is in a state (hereinafter referred to as "surface coated part region 4") coated with the alumina hydrate 5 in the vicinity of the boundary portion 9. As illustrated in FIG. 4, large voids 7 and small voids 8 are present between fibers making up the substrate 1. The fibrous material forming these voids is all coated with the alumina hydrate 5 in the surface coated part region 4. As illustrated in FIG. 4, the voids 7 and 8 are spaces formed in a state that the alumina hydrate 5 has been exposed thereto. The alumina hydrate concentrated portion 51, at which the alumina hydrate 5 is concentrated, is formed in fine interspaces far smaller than the voids formed by the fibrous material intersected with or approached to each other. The fine interspaces are in a state filled with the alumina hydrate aggregate.

Here, the effect by the above-described constitution is described from the viewpoint of function though it is a presumption. The fact that the whole surface of the fibrous material is coated with the alumina hydrate means that alumina hydrate aggregate itself forms fine pores. Variations of fiber surfaces among fibers can be thereby corrected while retaining ink (or liquid) absorbency of the fibers themselves, and evenness of the surfaces is achieved, whereby evenness of the ink absorbency can be attained. The fibers thereby absorb a liquid to cause swelling and elongation. However, the quantity thereof is moderately controlled (an excessive liquid is diffused into others to uniform the quantity of existing water) by the presence of the alumina hydrate, and the degree of freedom thereof is suppressed within a certain range. In other words, the diffusibility of the ink absorbed can be improved to prevent the deformation of the fibers, which is caused by local abnormal swelling, and at the same time, a proportion of the deformation of the fibers can be reduced by coating the fibers with the alumina hydrate. The strength of the fibers can be enhanced by the presence of the alumina hydrate in plenty at the fine interspaces formed by the fibrous material intersected with or approached to each other (which does not fill in the pores). Further, the constitution that the voids among the fibers are left allows the deformation of the fibers by the absorption of the ink, whereby apparent changes can be absorbed to reduce the occurrence of cockling. In addition, the ink-receiving layer provided on the surface of the substrate can determine the upper limit of the deformation of the fibers and thus acts as one that can smooth the whole displacement. Any combination of these constitutions is considered to contribute to the respective effects of improvement in ink absorbency, resistance to curling, resistance to cockling and resistance to strike-through.

Most preferred embodiments of recording media according to the present invention will hereinafter be described. In addition, preferred evaluation methods thereof will also be described.

(Substrate)

A blend obtained by adding mechanical pulp such as bulky cellulose fiber, mercerized cellulose, fluffed cellulose or thermomechanical pulp to ordinary LBKP (Laulholz bleached kraft pulp) is preferred as the fibrous material making up the substrate. When such a blend is used, the stiffness of the substrate formed is heightened, so that it is difficult to cause cockling. The amount of the bulky pulp is preferably 10% by mass to 30% by mass based on the whole mass of the fibrous material. When paper that is a substrate used in the present invention is made by using such pulp as described above, it is preferable that no surface sizing treatment be conducted because interspaces among fibers are filled by the surface sizing treatment to deteriorate ink absorbency.

In the present invention, the fibrous material forming the substrate is treated so as to create a state that surfaces of fibers have been coated with an alumina hydrate in the vicinity of at least one surface of the substrate. By treating in this manner, the wettability of paper on the surfaces of the fibers thereof is improved, and moreover difference in wettability between fibers is ironed out to achieve even penetration and diffusion of an ink. As a result, the occurrence of curling and/or cockling can be inhibited. No surface sizing agent is used in this fibrous material, so that even application and distribution can be formed. In addition, any other cationic material is not used. If another cationic material is present, the application of fine particles of the alumina hydrate is not adequately conducted.

The alumina hydrate used in the above-described fibrous material is preferably an alumina hydrate of a boehmite structure. More specifically, the alumina hydrate of the boehmite structure has high affinity for inks (water and solvents), so that the speeds of absorption, penetration and diffusion of an ink can be raised. On the other hand, it is important to use neither a binder nor cationic particles.

Figure 7:
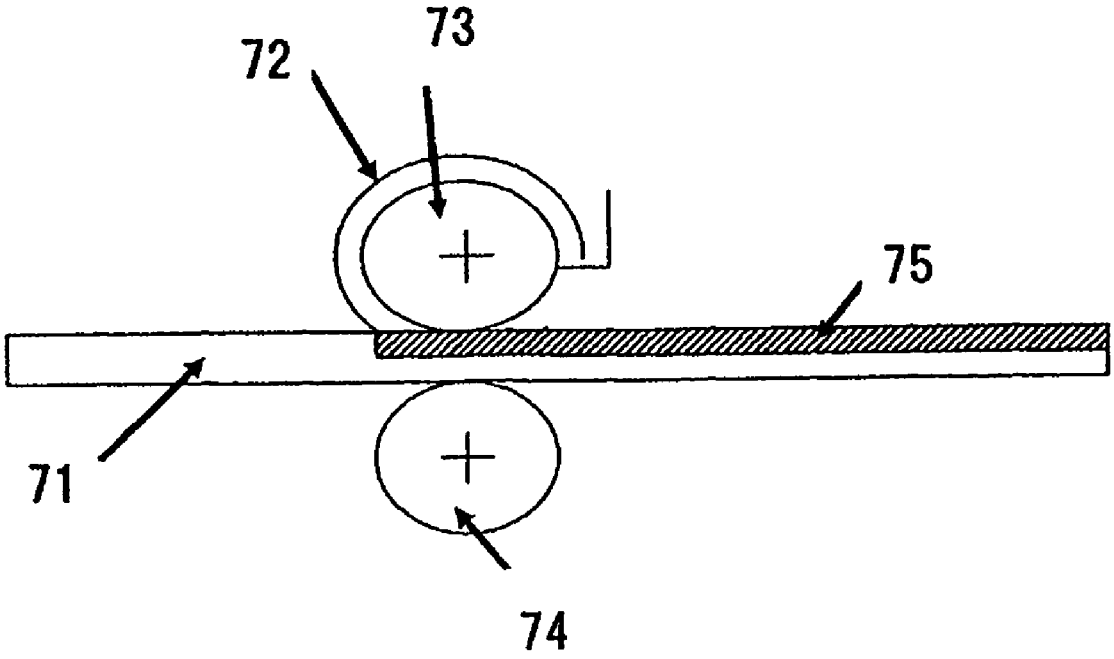
FIG. 7 schematically illustrates an example of a production process of a recording medium according to the present invention.

As a method for applying the alumina hydrate is preferred on-machine coating. It is preferred to apply the alumina hydrate right after the making of paper because all the fibers of a desired portion of the fibrous material can be coated with the alumina hydrate in a good state. Further, as a coating device for applying the alumina hydrate, it is most preferred to use a gate roll (see FIG. 7). When such a device is used, the depth (thickness) of the alumina hydrate penetrated into and applied to the substrate can be suitably controlled. Incidentally, in FIG. 7, reference numerals 71, 72, 73, 74 and 75 indicate a substrate, an alumina hydrate dispersion liquid, a coating roller, a conveying roller and an alumina hydrated coated portion, respectively.

(Ink-Receiving Layer)

As a porous inorganic pigment used in the formation of an ink-receiving layer, is preferably used porous silica. The porous inorganic pigment has a high percentage of voids. When the ink-receiving layer is formed with this material, ink absorbency and penetrability are improved. According to the investigation by the present inventors, a cockling-reducing effect has been brought about to the greatest extent when the porous silica is used as a material for forming the ink-receiving layer. Among investigated materials for forming the ink-receiving layer, the porous silica that has been able to bring about the highest effect has been silica having a pore radius (pores within particles) of 12 nm. Here, the porous silica is said to have pores having a wide volume within a radius of 50 nm or smaller (see Japanese Patent Publication No. S63-22997). Voids among fibers of paper are known to have pores within a radius range of from 0.2 μm to 10 μm (see Japanese Patent Publication No. S62-55996).

(Evaluation Method on Resistance to Cockling)

A printed recording medium absorbs an ink to change its dimensions. The evaluation as to the resistance to cockling has heretofore been made by measuring a height and a frequency (the number of waves per unit length) of waviness and an elongation percentage of a printed area. In the present invention, the evaluation has been made by measuring the elongation percentage because a recording medium having a low elongation percentage is harder to observe cockling by visual observation. The result in an Example is shown in FIG. 3. When printing was conducted on a recording medium according to the present invention, the elongation percentage was not changed even when the printing was conducted in an ink quantity exceeding 100%, and so no cockling was observed. However, in a conventional recording medium, a considerably high elongation percentage was exhibited in this case, and so cockling was observed.

In a recent investigation, it has been known that the height of waviness is not very different among recording media, and the frequency of waviness varies according to recording media. For example, when the frequency of waviness becomes short, the waviness is easy to be visually observed, and so such a recording medium is judged to cause cockling.

When the frequency of waviness becomes long to the contrary, the waviness is hard to be observed.

(Effects)

It has been confirmed that the recording medium of the structure described above brings about the following effects when an image is formed thereon. In addition, the recording medium of the structure described above permits forming an ink-receiving layer at high speed thereon, so that it has good productivity.

1) Curling after printing is small.

2) Cockling after printing is small.

3) Ink absorbency is good.

4) Strike-through is not caused in a printed area.

The reason why the occurrence of cockling in the recording medium of the above-described structure according to the present invention is reduced when an ink is applied to the recording medium to form an image is considered to be as follows. Description is given with reference to FIG. 5. Droplets of an ink applied to the recording medium are absorbed in an ink-receiving layer 2 and then penetrate and diffuse into a substrate 1. The cockling is uneven waviness (i.e., including waviness having a short frequency) of the recording medium, so that the waviness becomes hard to be observed when the absorption of the ink is even at this time, and the occurrence of cockling can be reduced. Here, the ink-receiving layer 2 is composed of a porous layer comprising a porous inorganic pigment 3 and a binder as principal components, so that the absorption of the ink can be made even in the ink-receiving layer 2.

Since the fibrous material forming the substrate 1 is uneven in its form, however, the radius (size) of voids formed among fibers has a wide distribution, so that it is difficult to make the absorption of the ink even, and so irregular waviness is caused. In the recording medium according to the present invention on the other hand, the surface of the fibrous material in the vicinity of a boundary portion 9 with the ink-receiving layer 2 is coated with an alumina hydrate 5. Therefore, great voids among fibers, which are present in this surface coated part region 4, are made smaller in radius compared with uncoated voids. Further, alumina hydrate aggregate is concentrated in fine interspaces, and so the interspaces are filled with the alumina hydrate aggregate (a portion indicated by reference numeral 51 in FIG. 5).

As a result, in the surface coated part region of the substrate making up the recording medium according to the present invention, the radius of the voids is relatively even, and the radius distribution of the voids is narrow compared with the case of uncoated voids. As a result, the ink absorbed in the ink-receiving layer 2 and penetrated into the surface coated part region 4 of the substrate 1, which adjoins the ink-receiving layer 2, is considered to be evenly diffused. Further, base paper making up the substrate 1 is in a state that fine fibers called fibrils have been entangled in addition to a portion of cell walls by a beating treatment upon the making of paper. In the recording medium according to the present invention, a fibrous material 41 of the surface coated part region making up the substrate 1 is coated with the alumina hydrate aggregate 5 as illustrated in FIG. 5, so that the wettability with the ink of a portion at which the fibers are entangled is made even, and is substantially uniformed. In this regard, the recording medium according to the present invention can make the penetration and diffusion of the ink penetrated into the substrate 1 even.

Further, in the recording medium according to the present invention, the alumina hydrate aggregate 5 is applied to the fibrous material 41 of the surface coated part region making up the substrate 1, whereby the expansion coefficient and deformation coefficient of the fibrous material 41 are controlled low. In addition, the fibrous material 41 is coated with the alumina hydrate aggregate 5, whereby the fibers are strongly bonded to each other. It is inferred that chemical bonding between the ink-receiving layer 2 and the substrate 1 is created by coating the fibrous material with the alumina hydrate aggregate 5. The present inventors infer that the occurrence of cockling on a printed article is reduced by these facts.

The recording medium according to the present invention has good ink absorbency. The reason for it is inferred from the fact that even when the substrate 1 contains the alumina hydrate aggregate 5, the great voids 7 are present among fibrous materials of the surface coated part region as described above, and voids 6 are present in the ink-receiving layer 2 comprising the porous inorganic pigment as a principal component, so that voids are in a continuously linked form at the boundary portion 9 between the substrate 1 and the ink-receiving layer 2.

Further, in the recording medium according to the present invention, good ink absorbency is achieved by the above-described structure even when both substrate and ink-receiving layer are thin, and an effect that no strike-through is caused even when a great amount of an ink is applied to the ink-receiving layer is also obtained.

The recording medium according to the present invention comprises the fibrous material and is obtained by coating a substrate, in the vicinity of at least one surface of which an alumina hydrate has been caused to exist, with an aqueous dispersion comprising a porous inorganic pigment as a principal component and drying it. According to the investigation by the present inventors, in the step of applying the aqueous dispersion comprising the porous inorganic pigment as a principal component, the color of the dispersion liquid applied turns from white to transparence in a moment that the dispersion liquid has come into the substrate. From this result, it can be inferred that some reaction takes place between the substrate and the dispersion liquid. The dispersion liquid applied remains on the substrate without penetrating into the substrate. By virtue of this reaction, it is considered that the porous structure of the ink-receiving layer is retained even when high-speed coating is conducted in the case where the recording medium according to the present invention is produced, and moreover a good ink-receiving layer free from the occurrence of cracking can be formed.

The respective components making up the recording medium according to the present invention, and the like will hereinafter be described in more detail.

(Fibrous Material of Substrate)

The substrate according to the present invention is composed mainly of a fibrous material. As this fibrous material, may be used cellulose pulp. Specific examples thereof include chemical pulp obtained by Laulholz and Nadelholz materials, such as sulfite pulp (SP), alkaline pulp (AP) and kraft pulp (KP), semichemical pulp, semimechanical pulp, and mechanical pulp. Further, waste paper pulp that is deinked secondary fiber may also be used. The pulp may be used without distinction of unbleached pulp and bleached pulp, and beating and unbeating. As the beat or cellulose pulp, fibers of grass, leaves, bast, seed hair and the like, for example, pulp from straw, bamboo, hemp, bagasse, kenaf, *Edgeworthia papyrifera*, cotton linter and the like, may also be used as described above.

In the present invention, at least one selected from mechanical pulp such as bulky cellulose fiber, mercerized cellulose, fluffed cellulose and thermomechanical pulp, and the like may be added for use in addition to the above-described cellulose pulp. By the addition of such pulp, the ink-absorbing speed and ink-absorbing capacity of the resulting recording medium can be improved.

In the recording medium according to the present invention, at least one selected from among fine fibrillated cellulose, crystallized cellulose, sulfate pulp making use of Laulholz or Nadelholz as a raw material, sulfite pulp, soda pulp, hemicellulase-treated pulp and enzyme-treated chemical pulp may be added for use in addition to the above-described cellulose pulp. The addition of such pulp brings about such effects that the smoothness and formation of the resulting recording medium are improved.

In the present invention, that of either a singly-layer structure or a multi-layer structure may be used as the fibrous material forming the substrate without a particular limitation. Examples of preferred embodiments of the substrate of the multi-layer structure include the structure described in Japanese Patent Application Laid-Open No. 2000-211250.

In the present invention, a filler may be added to the fibrous material forming the substrate as needed. For example, a white pigment such as precipitated calcium carbonate or heavy calcium carbonate may be used as the filler. In the present invention, a structure adding no filler may also be taken for the purpose of increasing the ink-absorbing speed.

In the recording-medium according to the present invention, it is important that voids are present among fibers of the fibrous material as described above. Accordingly, non-sized paper subjected to no surface sizing treatment is provided upon the production of the substrate. The reason for it is that when a size press treatment with starch or the like, which has heretofore been conducted, is carried out upon the making of the paper, the voids among the fibers are filled. In addition, the application of the alumina hydrate aggregate to the fibers cannot be made.

No particular limitation is imposed on the whole basis weight of the recording medium according to the present invention so far as the recording medium does not become extremely thin due to a low basis weight. The basis weight is preferably within a range of, for example, from 40 g/m$^2$ to 300 g/m$^2$ from the viewpoint of conveyability upon printing by a printer or the like. A more preferred range of the basis weight is from 45 g/m$^2$ to 200 g/m$^2$. When the basis weight falls within this range, the opacity of the paper can be raised without enhancing its folding strength. In addition, blocking is hard to be caused even when a great number of printed samples are stacked.

(Alumina Hydrate Applied to Substrate)

Since the alumina hydrate has a positive charge, it has a merit that an image excellent in coloring property can be provided by containing it in the recording medium. The alumina hydrate is defined by the following general formula.

$$Al_2O_{3-n}(OH)_{2n}\cdot mH_2O$$

wherein n is an integer of from 0 to 3, m is a number of 0 to 10, preferably 0 to 5. In many cases, $mH_2O$ represents an aqueous phase, which does not participate in the formation of a crystal lattice, but is able to eliminate. Therefore, m may take a value other than an integer. However, m and n are not 0 at the same time.

The alumina hydrate present in the recording medium according to the present invention may be most preferably an alumina hydrate showing a boehmite structure when analyzed by the X-ray diffractometry because it has good ink absorbency, colorant-adsorbing ability and coloring ability. The alumina hydrate of the boehmite structure used in the present invention shows a boehmite structure when analyzed by the X-ray diffractometry. Examples of preferred materials thereof include those described in Japanese Patent Nos. 2714350, 2714351 and 2714352. The alumina hydrate preferably used in the present invention is that having a porous structure.

In the recording medium according to the present invention, the range of the alumina hydrate particularly preferred for reducing the cockling is as follows. The shape of the alumina hydrate in a flat-plate form is preferably such that an aspect ratio is within a range of from 3 to 10, and an average particle diameter is within a range of from 1 nm to 50 nm. When the alumina hydrate is in the form of agglomerate of fine particles like a hair bundle, it is preferably such that an aspect ratio is within a range of from 3 to 10, and an average particle length is within a range of from 1 nm to 50 nm. The alumina hydrate used preferably has a BET specific surface area ranging from 70 m$^2$/g to 300 m$^2$/g. The crystal thickness in a direction perpendicular to the (010) plane thereof is preferably within a range of from 6.0 nm to 15.0 nm. Incidentally, the various values of the alumina hydrate as described above may be measured in accordance with the respective methods described in Japanese Patent Application Laid-Open No. 2002-211121.

(Production Process of Substrate)

A paper making process generally used may be applied to a production process of the substrate used in the recording medium according to the present invention. A paper machine may be chosen for used from among a Fourdrinier paper machine, a cylinder paper machine, a round-shape paper machine, a twin-wire former and the like.

In the recording medium according to the present invention, the alumina hydrate is applied in place of a size pressing step that is conducted in the production process of ordinary paper. As a method for applying the alumina hydrate, on machine coating is preferred. A method of the on-machine coating may be chosen for use from among general coating methods. For example, a coating technique making use of a gate roll coater, size press, bar coater, blade coater, air knife coater, roll coater, brush coater, curtain coater, gravure coater, sprayer or the like may be adopted.

If the coating weight of the alumina hydrate is too great, a layer thereof is formed to fail to retain the voids among the fibers of the substrate. If the coating weight is too small, the above-described cockling-reducing effect on the resulting recording medium is not exhibited. A preferable coating weight of the alumina hydrate in the present invention is preferably within a range of from 0.5 g/m$^2$ to 4 g/m$^2$, more preferably from 1 g/m$^2$ to 3 g/m$^2$ per one surface. When the coating weight falls within this range, cissing of the liquid can be prevented in the step of coating the fibrous material with the alumina hydrate, and moreover the surface strength of the resulting substrate can be enhanced.

In the present invention, a substrate obtained by further subjecting the on-machine coated substrate to a calendering treatment or super-calendering treatment as needed to smooth the surface thereof may be used.

(Materials for Forming Ink-Receiving Layer)

Main materials for forming the ink-receiving layer of the recording medium according to the present invention are a porous inorganic pigment and a binder. The porous inorganic pigment may be chosen for use from among, for example, porous silica, porous calcium carbonate and porous magnesium carbonate. As described above, porous silica is most preferred in that it has a great pore volume.

The binder for the ink-receiving layer in the present invention may be freely selected from among the following water-soluble polymers. For example, polyvinyl alcohol or modified products (cationically modified products, anionically modified products, silanol-modified products) thereof, starch or modified products (oxide, etherified products) thereof, gelatin or modified products thereof, casein or modified products thereof, carboxymethyl cellulose, gum arabic, cellulose derivatives such as hydroxyethyl cellulose and hydroxypropylmethyl cellulose, conjugated diene copolymer latexes such as SBR latexes, NBR latexes and methyl methacrylate-butadiene copolymers, functional group-modified polymer latexes, vinyl copolymer latexes such as ethylene-vinyl acetate copolymers, polyvinyl pyrrolidone, maleic anhydride polymers or copolymers thereof, and acrylic ester copolymers may be preferably used. These binders may be used either singly or in any combination thereof. A mixing proportion of the binder to the porous inorganic pigment is preferably 5 to 70 parts by mass per 100 parts by mass of the pigment. If the amount of the binder is less than the lower limit of the above range, the mechanical strength of the resulting ink-receiving layer is insufficient to have a possibility that cracking or dusting may be caused. If the amount of the binder is more than the upper limit of the above range, there is a possibility that the ink absorbency of the resulting ink-receiving layer may be lowered.

In the recording medium according to the present invention, a cationic material is preferably used in the formation of the ink-receiving layer for the purpose of improving coloring ability and abrasion resistance of an image formed. The cationic material may be suitably chosen for use from among materials such as quaternary ammonium salts, polyamines, alkylamines, quaternary ammonium halides, benzalkonium chloride, benzethonium chloride and dimethyldiallylammonium chloride polymers.

In the recording medium according to the present invention, the amount of an electrolyte material such as such a cationic material as described above, which is contained in the ink-receiving layer, is controlled, whereby the surface resistivity of the ink-receiving layer can be controlled. A preferred range of the surface resistivity in the present invention is a range from $1\times10^{9}$ $\Omega/m^2$ to $1\times10^{12}$ $\Omega/m^2$. The recording medium may be charged in the course of being conveyed in the interior of, for example, an ink-jet recording apparatus. When an ink-jet recording is conducted on a charged recording medium, an ink rebounds from the recording medium after the ink strikes on the recording medium, whereby ink mist may occur in some cases. However, the surface resistivity of the recording medium is controlled within the above range, whereby the occurrence of such ink mist can be reduced.

In the present invention, dispersants, thickeners, pH adjustors, lubricants, flowability modifiers, surfactants, antifoaming agents, water-proofing agents, foam suppressors, parting agents, foaming agents, penetrants, coloring dyes, optical whitening agents, ultraviolet absorbents, antioxidants, antiseptics, mildewproofing agents and/or the like may also be added to the above-described materials for forming the ink-receiving layer as needed.

(Process for Forming Ink-Receiving Layer)

In the recording medium according to the present invention, which has an ink-receiving layer, as a process for forming the ink-receiving layer on a substrate, may be adopted a process comprising preparing an aqueous dispersion composed of the above-described porous inorganic pigment, binder and other additives, and the like, coating the substrate with the dispersion liquid by means of a coater and drying it. As a coating method used in this process, may be adopted a coating technique by means of a blade coater, air knife coater, roll coater, brush coater, curtain coater, bar coater, gravure coater or sprayer. When the coating weight of the dispersion liquid falls within a range of from 5 $g/m^2$ to 30 $g/m^2$ in terms of dry solids content, the resulting recording medium can satisfy both ink absorbency and resistance to cockling. The coating weight is more preferably within a range of from 7 $g/m^2$ to 20 $g/m^2$. When the coating weight falls within this range, the surface strength of the ink-receiving layer can be enhanced. After the formation of the ink-receiving layer, the surface smoothness of the ink-receiving layer may also be improved by means of a calendar roll or the like as needed.

(Ink Used in Image Forming Process of the Present Invention)

The image forming process according to the present invention comprises the step of applying droplets of an ink to an ink-receiving layer provided on a recording medium to conduct printing, wherein the recording medium according to the present invention, which has the above-described structure is used as the recording medium. As the ink used in this process, may be used that comprising mainly a colorant (dye or pigment), a water-soluble organic solvent and water.

As the dye, is preferably used any of water-soluble dyes represented by, for example, direct dyes, acid dyes, basic dyes, reactive dyes and food colors. However, any dyes may be used so far as they provide images satisfying required performance such as fixing ability, coloring ability, brightness, stability, light fastness and the like in combination with the recording medium according to the present invention, which has the above-described structure. As the pigment, may be used carbon black or the like. In this case, as a method for preparing a pigment ink, may be used a method of using a pigment and a dispersant in combination, a method of using a self-dispersing pigment, a method of microcapsulating a pigment, or the like.

The water-soluble dye is generally used by dissolving it in water or a solvent composed of water and at least one organic solvent. As these solvent components and solvents for dispersing the pigment, are preferably used mixtures composed of water and at least one of various water-soluble organic solvents. In this case, it is preferable to control the content of water in an ink within a range of from 20% by mass to 90% by mass.

Examples of the water-soluble organic solvents include alkyl alcohols having 1 to 4 carbon atoms, such as methyl alcohol; amides such as dimethylformamide; ketones and ketone alcohols such as acetone; ethers such as tetrahydrofuran; polyalkylene glycols such as polyethylene glycol; alkylene glycols the alkylene moiety of which has 2 to 6 carbon atoms, such as ethylene glycol; glycerol; and lower alkyl ethers of polyhydric alcohols, such as ethylene glycol methyl ether. One selected from these solvents or a combination of 2 or more solvents selected from these solvents may be used.

Among these many water-soluble organic solvents, polyhydric alcohols such as diethylene glycol, and lower alkyl ethers of polyhydric alcohol, such as triethylene glycol monomethyl ether and triethylene glycol monoethyl ether are particularly preferably used. The polyhydric alcohols are particularly preferred because they have an effect as a lubricant for reducing or preventing the clogging of nozzles, which is based on the evaporation of water in an ink and hence the deposition of a water-soluble dye.

A solubilizer may also be added to the ink. Typical solubilizers include nitrogen-containing heterocyclic ketones. Its intended action is to enhance the solubility of a water-soluble dye in a solvent by leaps and bounds. For example, N-methyl-2-pyrrolidone and 1,3-dimethyl-2-imidazolidinone are preferably used. In order to further improve the properties of the ink, additives such as viscosity modifiers, surfactants, surface tension modifiers, pH adjustors and resistivity regulative agents may also be added for use.

(Printing Method)

As a method for applying such an ink as described above to the recording medium according to the present invention to form an image, is preferred an ink-jet recording method. As such an ink-jet method, any system may be used so far as it can effectively eject an ink out of an orifice (nozzle) to apply it to the recording medium. In particular, an ink-jet recording system described in Japanese Patent Application Laid-Open No. S54-59936, in which an ink undergoes a rapid volumetric change by an action of thermal energy applied to the ink, and so the ink is ejected out of an nozzle by the working force generated by this change of state, may be used effectively.

EXAMPLES

The present invention will hereinafter be described more specifically by the following Examples. However, the scope of the present invention is not limited by the Examples. A specific method for forming a print on recording media of Examples and Comparative Examples, and evaluation methods as to the resulting prints are as follows.

1) Printing Apparatus:

An Ink-jet Printer 990i (manufactured by Canon Inc.) was used as a recording apparatus to conduct printing on respective recording media of Examples and Comparative Examples. Inks and dyes used in the formation of images are those described below. Composition (100 parts in total) of aqueous inks:

| | |
|---|---|
| Dye described below | 3 parts |
| Surfactant (SURFYNOL 465, product of Nissin Chemical Industry Co., Ltd.) | 1 part |
| Diethylene glycol | 5 parts |
| Polyethylene glycol | 10 parts |
| Ion-exchanged water | Balance. |

Dyes (dyes for inks):

Y: C.I. Direct Yellow 86
M: C.I. Acid Red 35
C: C.I. Direct Blue 199
Bk: C.I. Food Black 2.

2) Recording Medium:

As recording media, those having a size of 210 mm×297 mm were used to form prints, and the prints were evaluated.

The measurements of various properties and evaluation as to the prints obtained above were conducted with the following points in mind.

1. Resistance to Curling after Printing:

A square solid pattern of 150 mm×150 mm was printed on a central portion of a recording medium with 2 colors (200%) by means of the printer. The printed recording medium was then placed on a flat table and left at rest for 1 hour to measure the height of warpage by a height gage, thereby evaluating the recording medium in accordance with the following 5-rank standard. The resistance to curling of the recording medium was ranked as "AA" where the height was not more than 1 mm, "A" where the height was more than 1 mm, but not more than 3 mm, "B" where the height was more than 3 mm, but not more than 5 mm, "C" where the height was more than 5 mm, but not more than 7 mm, or "D" where the height was more than 7 mm.

2. Resistance to Cockling after Printing:

A square solid pattern of 150 mm×150 mm was printed on a central portion of a recording medium with 2 colors (200%) by means of the printer. The surface of the recording medium right after the printing was visually observed to evaluate the recording medium in accordance with the following 3-rank standard. The resistance to cockling of the recording medium was ranked as "A" where neither cockling nor deformation of the paper was observed when the recording medium was observed from the front and slant directions of the printed image, "B" where cockling was observed when the recording medium was observed from the slant direction of the printed image, but neither cockling nor deformation of the paper was observed when the recording medium was observed from the front direction of the printed image, or "C" where deformation and changes such as cockling were clearly observed when the recording medium was observed from the front direction of the printed image.

Further, printing was conducted in an ink quantity of from 100% (single color) to 400% (4-color mixing) on a recording medium by means of the printer in the same manner as described above. With respect to the printed areas of these recording media, a length of a printing area of each recording medium before the printing, and a length of the printed area after the printing were measured to determine an elongation percentage in accordance with the following equation:

Elongation percentage=(Length of printed area after printing)/(Length of printing area before printing)×100.

3. Resistance to Strike-Through:

Solid printing from a single color to 3 colors was conducted by means of the printer. The print thus obtained was left to stand for 1 hour after the printing, and the recording medium was then visually observed from a side opposed to the printed surface to check whether strike-through occurred or not, thereby evaluating the recording medium in accordance with the following standard. The resistance to strike-through of the recording medium was ranked as "A" where no strike-through occurred in an ink quantity of 300% (3-color mixing), "B" where no strike-through occurred in an ink quantity of 200% (2-color mixing), "C" where no strike-through occurred in an ink quantity of 100% (single color), or "D" where strike-through occurred in an ink quantity of 100%.

4. Absorbency:

A dynamic scanning absorptometer (manufactured by Toyo Seiki Seisaku-sho, Ltd.) was used, the following liquid was brought into contact with each recording medium to measure an amount of the liquid absorbed, thereby evaluating the recording medium in accordance with the following standard. The absorbency of the recording medium was ranked as "AA" where an amount of the liquid transferred in a contact time of 25 milliseconds was not less than 40 ml/m$^2$, "A" where the amount was less than 40 ml/m$^2$, but not less than 30 ml/m$^2$, "B" where the amount was less than 30 ml/m$^2$, but not less than 20 ml/m$^2$, "C" where the amount was less than 20 ml/m$^2$, but not less than 10 ml/m$^2$, or "D" where the amount was 10 ml/m$^2$.

As the liquid used in the above-described measurement, was used an aqueous ink having the following composition.

| | |
|---|---|
| 10% aqueous solution of a styrene-Methacrylic acid copolymer | 20 parts |
| C.I. Pigment Blue 15:3 | 10 parts |
| Glycerol | 20 parts |
| Diethylene glycol | 20 parts |
| Triethylene glycol | 10 parts |
| Water | 20 parts. |

Example 1

Commercially available LBKP as raw pulp was beaten by a double disk refiner to provide a beat stock (A) having a Canadian standard freeness (C.S.F.) of 300 ml. Commercially available LBKP was beaten by the same machine as described above to provide a beat stock (B) having a Canadian standard freeness of 500 ml. The beat stock (A) and beat stock (B) were mixed in a proportion of 9:1 in terms of a dry mass ratio to obtain a raw material for paper.

The conventionally known alumina hydrate of a boehmite structure, which is described in Example 1 of Japanese Patent No. 2714352, was dispersed in ion-exchanged water to prepare an aqueous dispersion of the alumina hydrate having a solid content concentration of 10% by mass. An on-machine coating liquid was then prepared by using this dispersion liquid.

The above-described raw material for paper was used to make paper having a basis weight of 80 g/m$^2$ by means of a Fourdrinier paper machine. The on-machine coating liquid previously obtained was applied to a surface of the paper thus obtained by a two-roll size press so as to give a coating weight of 2 g/m$^2$, and the surfaces of the coated paper were further smoothed by a super-calender to obtain a substrate 1. A portion of the thus-obtained substrate 1, on which the alumina hydrate had been applied, was observed through an electron microscope. As a result, it was confirmed that the substrate has a surface coated part region, in which at least a surface of the fibrous material has been coated with alumina hydrate aggregate, and voids are present as illustrated in FIG. 5. The thickness of the surface coated part region was 30 μm.

Figure 6:
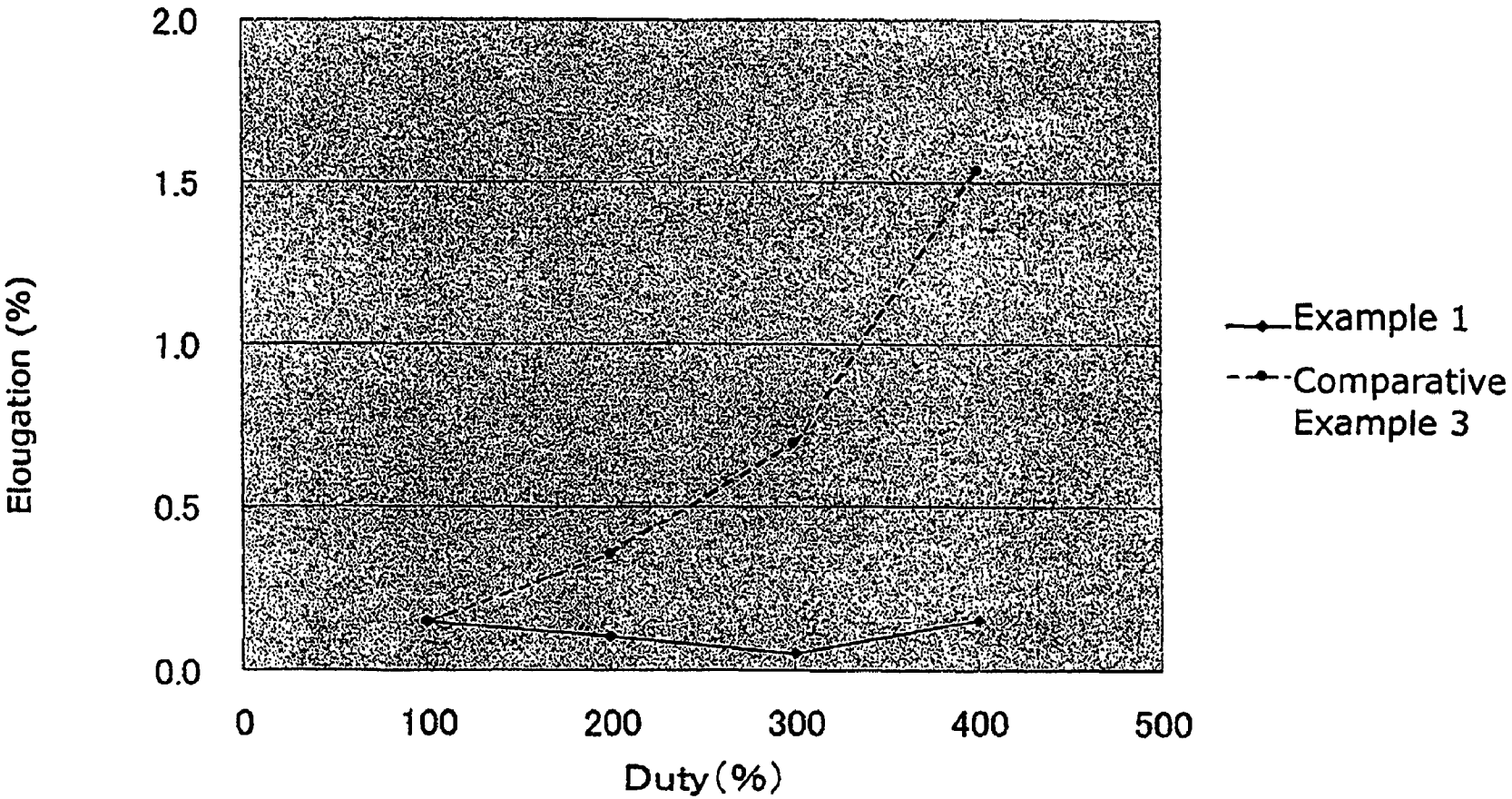
FIG. 6 diagrammatically illustrates the relationship between the quantity of an ink applied and an elongation percentage in recording media according to EXAMPLE 1 of the present invention and COMPARATIVE EXAMPLE 3.

One hundred parts by mass of porous silica (CARPLEX BS-312AM, product of Shionogi & Co., Ltd.) and 37 parts by mass of polyvinyl alcohol (PVA 117, product of Kuraray Co., Ltd.) as a binder were dispersed in ion-exchanged water to prepare a dispersion liquid for coating having a dry solid content concentration of 20% by mass. The thus-obtained dispersion liquid for coating was applied to the above-obtained substrate on a side of the surface coated part region, in which the alumina hydrate had been applied, by means of a bar coater and then dried to form an ink-receiving layer having a solid content of 10 g/m$^2$. Thereafter, the surface of the ink-receiving layer was smoothed by a super-calender. A printed article obtained by conducting printing on the thus-obtained recording medium of this Example by the process described above was evaluated in accordance with the above-described methods and standards. The results are shown in Table 1. In this Example, the result of an elongation percentage of the recording medium, which was measured in accordance with the method described above, is shown in FIG. 6.

Example 2

Paper was made by using the same beat stocks (A) and (B) as those used in EXAMPLE 1 and employing the same paper machine as that used in EXAMPLE 1 so as to give the same basis weight as in EXAMPLE 1, and the alumina hydrate in the same amount as in EXAMPLE 1 was applied to the paper using the same on-machine coating liquid and process as those used in EXAMPLE 1. Further, a smoothing treatment was conducted in the same manner as in EXAMPLE 1 to obtain a substrate.

One hundred parts by mass of the alumina hydrate of a boehmite structure, which is described in Example 1 of Japanese Patent Application Laid-Open No. H9-99627, and 15 parts by mass of polyvinyl alcohol (PVA 117, product of Kuraray Co., Ltd.) were dispersed in ion-exchanged water to prepare a dispersion liquid for coating having a dry solid content concentration of 15% by mass. The thus-obtained dispersion liquid for coating was applied on to the above-obtained substrate by means of a bar coater and then dried to form an ink-receiving layer having a solid content of 10 g/m$^2$. The surface of the ink-receiving layer was further smoothed by the same method as in EXAMPLE 1. The thus-obtained recording medium of this Example was evaluated in the same manner as in EXAMPLE 1. The results are shown in Table 1.

Example 3

Paper was made by using the same beat stocks (A) and (B) as those used in EXAMPLE 1 and employing the same paper machine as that used in EXAMPLE 1 so as to give the same basis weight as in EXAMPLE 1, and the same on-machine coating liquid as that used in EXAMPLE 1 was used to apply the alumina hydrate in the same amount as in EXAMPLE 1 by the same method as in EXAMPLE 1. Further, a smoothing treatment was conducted in the same manner as in EXAMPLE 1 to obtain a substrate.

The same materials as those used in EXAMPLE 1 were used to prepare the same dispersion liquid for coating as in EXAMPLE 1, thereby forming an ink-receiving layer having a solid content of 7 g/m$^2$ in the same manner as in EXAMPLE 1. The surface of the ink-receiving layer was smoothed by the same method as in EXAMPLE 1. The thus-obtained recording medium of this Example was evaluated in the same manner as in EXAMPLE 1. The results are shown in Table 1.

Example 4

Paper was made by using the same beat stocks (A) and (B) as those used in EXAMPLE 1 and employing the same paper machine as that used in EXAMPLE 1 so as to give the same basis weight as in EXAMPLE 1, and the same alumina hydrate as that used in EXAMPLE 1 was used to conduct coating by the same on-machine coating method as in EXAMPLE 1 so as to give a coating weight of 0.5 g/m$^2$. A smoothing treatment was conducted in the same manner as in EXAMPLE 1 to obtain a substrate. A portion of the thus-obtained substrate, on which the alumina hydrate had been applied, was observed through an electron microscope. As a result, it was confirmed that the substrate has a surface coated part region, in which at least a surface of the fibrous material has been coated with alumina hydrate, and voids are present as illustrated in FIG. 5. The thickness of the surface coated part region was 20 μm.

The same materials as those used in EXAMPLE 1 were used to form an ink-receiving layer having the same coating weight as in EXAMPLE 1 in the same manner as in EXAMPLE 1. The surface of the ink-receiving layer was smoothed by the same method as in EXAMPLE 1. The thus-obtained recording medium of this Example was evaluated in the same manner as in EXAMPLE 1. The results are shown in Table 1.

Example 5

Paper was made by using the same beat stocks (A) and (B) as those used in EXAMPLE 1 and employing the same paper machine as that used in EXAMPLE 1 so as to give the same basis weight as in EXAMPLE 1, and the same on-machine coating liquid as that used in EXAMPLE 1 was used to apply the alumina hydrate by the same on-machine coating method as in EXAMPLE 1 so as to give a coating weight of 4 g/m$^2$. A smoothing treatment was conducted in the same manner as in EXAMPLE 1 to obtain a substrate. A portion of the thus-obtained substrate, on which the alumina hydrate had been applied, was observed through an electron microscope. As a result, it was confirmed that the substrate has a surface coated part region, in which at least a surface of the fibrous material has been coated with the alumina hydrate, and voids are present as illustrated in FIG. 5. The thickness of the surface coated part region was 40 μm.

The same materials as those used in EXAMPLE 1 were used to form an ink-receiving layer having the same coating weight as in EXAMPLE 1 in the same manner as in EXAMPLE 1. The surface of the ink-receiving layer was smoothed by the same method as in EXAMPLE 1. The thus-obtained recording medium of this Example was evaluated in the same manner as in EXAMPLE 1. The results are shown in Table 1.

Example 6

A beat stock (C) prepared from crosslinked pulp (High Bulk Additive, trade name, product of Weyerhaeuser Paper Co.) having a twisted structure as bulky cellulose fiber was used in place of the beat stock (B) used in EXAMPLE 1, and paper was made by using the beat stocks (A) and (C) and employing the same paper machine as that used in EXAMPLE 1 so as to give the same basis weight as in EXAMPLE 1. The same on-machine coating liquid as that used in EXAMPLE 1 was used to apply the alumina hydrate in the same amount as in EXAMPLE 1 by the same method as in EXAMPLE 1. A smoothing treatment was conducted in the same manner as in EXAMPLE 1 to obtain a substrate.

The same materials as those used in EXAMPLE 1 were used to form an ink-receiving layer having the same coating weight as in EXAMPLE 1 in the same manner as in EXAMPLE 1. The surface of the ink-receiving layer was smoothed by the same method as in EXAMPLE 1. The thus-obtained recording medium of this Example was evaluated in the same manner as in EXAMPLE 1. The results are shown in Table 1.

Example 7

Paper was made by using the same beat stocks (A) and (B) as those used in EXAMPLE 1 and employing the same paper machine as that used in EXAMPLE 1 so as to give the same basis weight as in EXAMPLE 1, and the same on-machine coating liquid as that used in EXAMPLE 1 was used to apply the alumina hydrate in the same amount as in EXAMPLE 1 by the same method as in EXAMPLE 1. A smoothing treatment was conducted in the same manner as in EXAMPLE 1 to obtain a substrate.

One hundred parts by mass of porous calcium carbonate (ESKALON #1500, product of Sankyo Seifun K.K.) and 20 parts by mass of polyvinyl alcohol (PVA 117, product of Kuraray Co., Ltd.) as a binder were dispersed in ion-exchanged water to prepare a dispersion liquid for coating having a dry solid content concentration of 20% by mass to form an ink-receiving layer having the same coating weight as in EXAMPLE 1 in the same manner as in EXAMPLE 1. The surface of the ink-receiving layer was smoothed by the same method as in EXAMPLE 1. The thus-obtained recording medium of this Example was evaluated in the same manner as in EXAMPLE 1. The results are shown in Table 1.

Example 8

Paper was made by using the same beat stocks (A) and (B) as those used in EXAMPLE 1 and employing the same paper machine as that used in EXAMPLE 1 so as to give the same basis weight as in EXAMPLE 1, and the same on-machine coating liquid as that used in EXAMPLE 1 was used to apply the alumina hydrate in the same amount as in EXAMPLE 1 by the same method as in EXAMPLE 1. A smoothing treatment was conducted in the same manner as in EXAMPLE 1 to obtain a substrate.

One hundred parts by mass of porous magnesium carbonate (GP-30, product of Konoshima Chemical Co, Ltd.) and 20 parts by mass of polyvinyl alcohol (PVA 117, product of Kuraray Co., Ltd.) as a binder were dispersed in ion-exchanged water to prepare a dispersion liquid for coating having a dry solid content concentration of 20% by mass to form an ink-receiving layer having the same coating weight as in EXAMPLE 1 in the same manner as in EXAMPLE 1. The surface of the ink-receiving layer was smoothed by the same method as in EXAMPLE 1. The thus-obtained recording medium of this Example was evaluated in the same manner as in EXAMPLE 1. The results are shown in Table 1.

Example 9

Paper was made by using the same beat stocks (A) and (B) as those used in EXAMPLE 1 and employing the same paper machine as that used in EXAMPLE 1 so as to give the same basis weight as in EXAMPLE 1, and the same on-machine coating liquid as that used in EXAMPLE 1 was used to apply the alumina hydrate in the same amount as in EXAMPLE 1 by the same method as in EXAMPLE 1. A smoothing treatment was conducted in the same manner as in EXAMPLE 1 to obtain a substrate.

The substrate obtained above was provided as a recording medium of this Example without forming an ink-receiving layer. The thus-obtained recording medium of this Example was evaluated in the same manner as in EXAMPLE 1. The results are shown in Table 1.

Comparative Example 1

Paper was made by using the same beat stocks (A) and (B) as those used in EXAMPLE 1 and employing the same paper machine as that used in EXAMPLE 1 so as to give the same basis weight as in EXAMPLE 1, and a smoothing treatment was conducted in the same manner as in EXAMPLE 1 to obtain a substrate. No coating with the alumina hydrate was conducted. The substrate obtained above was provided as a recording medium of COMPARATIVE EXAMPLE 1 without forming an ink-receiving layer. The thus-obtained recording medium of this Comparative Example was evaluated in the same manner as in EXAMPLE 1. The results are shown in Table 1.

Comparative Example 2

In this Comparative Example, the same substrate as that used in COMPARATIVE EXAMPLE 1 was used. The same materials as those used in EXAMPLE 2 were used to prepare the same dispersion liquid for coating as that prepared in EXAMPLE 2, thereby forming an ink-receiving layer having the same coating weight as in EXAMPLE 2 on the substrate in the same manner as in EXAMPLE 2. The surface of the ink-receiving layer was smoothed by the same method as in EXAMPLE 2. The thus-obtained recording medium of this Comparative Example was evaluated in the same manner as in EXAMPLE 1. The results are shown in Table 1.

Comparative Example 3

In this Comparative Example, the same substrate as that used in COMPARATIVE EXAMPLE 1 was used. The same materials as those used in EXAMPLE 1 were used to prepare the same dispersion liquid for coating as that prepared in EXAMPLE 1, thereby forming an ink-receiving layer having the same coating weight as in EXAMPLE 1 on the substrate in the same manner as in EXAMPLE 1. The surface of the ink-receiving layer was smoothed by the same method as in EXAMPLE 1. The thus-obtained recording medium of this Comparative Example was evaluated in the same manner as in EXAMPLE 1. The results are shown in Table 1. In this Comparative Example, the result of an elongation percentage of the recording medium, which was measured in accordance with the method described above, is shown in FIG. 3.

Comparative Example 4

The same commercially available LBKP as that used in EXAMPLE 1 as raw pulp was beaten by a double disk refiner to provide a beat stock (A) having a Canadian standard freeness (C.S.F.) of 300 ml. The same commercially available LBKP as that used in EXAMPLE 1 was beaten by the same machine as described above to provide a beat stock (B) having a Canadian standard freeness of 500 ml. The thus-obtained beat stock (A) and beat stock (B) and porous silica (MIZUKASIL P-78A, product of Mizusawa Industrial Chemicals, Ltd.) were mixed in a proportion of 9:1:1 in terms of a dry mass ratio to prepare a raw material for paper. The thus-obtained raw material for paper was used to make paper having a basis weight of 80 g/m$^2$ by means of a Fourdrinier paper machine, and the surfaces of the paper were further smoothed by a super-calender to obtain a substrate. No coating with the alumina hydrate was conducted. The substrate obtained above was provided as a recording medium of COMPARATIVE EXAMPLE 4 without forming an ink-receiving layer. The thus-obtained recording medium of this Comparative Example was evaluated in the same manner as in EXAMPLE 1. The results are shown in Table 1.

Comparative Example 5

In this Comparative Example, the same substrate as that used in COMPARATIVE EXAMPLE 4 was used. The same materials as those used in EXAMPLE 2 were used to prepare the same dispersion liquid for coating as that prepared in EXAMPLE 2, thereby forming an ink-receiving layer having the same coating weight as in EXAMPLE 2 on the substrate in the same manner as in EXAMPLE 2. The surface of the ink-receiving layer was smoothed by the same method as in EXAMPLE 2. The thus-obtained recording medium of this Comparative Example was evaluated in the same manner as in EXAMPLE 1. The results are shown in Table 1.

Comparative Example 6

The same commercially available LBKP as that used in EXAMPLE 1 as raw pulp was beaten by a double disk refiner to provide a beat stock (A) having a Canadian standard freeness (C.S.F.) of 300 ml. The same commercially available LBKP as that used in EXAMPLE 1 was beaten by the same machine as described above to provide a beat stock (B) having a Canadian standard freeness of 500 ml. The thus-obtained beat stock (A) and beat stock (B) and the alumina hydrate of a boehmite structure, which is described in Example 1 of Japanese Patent No. 2714352, were mixed in a proportion of 9:1:1 in terms of a dry mass ratio to prepare a raw material for paper. The thus-obtained raw material for paper was used to make paper having a basis weight of 80 g/m$^2$ by means of a Fourdrinier paper machine, and the surfaces of the paper were further smoothed by a super-calender to obtain a substrate. No coating with the alumina hydrate was conducted. The substrate obtained above was provided as a recording medium of COMPARATIVE EXAMPLE 6 without forming an ink-receiving layer. The thus-obtained recording medium of this Comparative Example was evaluated in the same manner as in EXAMPLE 1. The results are shown in Table 1.

Comparative Example 7

In this Comparative Example, the same substrate as that used in COMPARATIVE EXAMPLE 6 was used. The prepare the same dispersion liquid for coating as that prepared in EXAMPLE 1, thereby forming an ink-receiving layer having the same coating weight as in EXAMPLE 1 on the substrate in the same manner as in EXAMPLE 1. The surface of the ink-receiving layer was smoothed by the same method as in EXAMPLE 1. The thus-obtained recording medium of this Comparative Example was evaluated in the same manner as in EXAMPLE 1. The results are shown in Table 1.

Comparative Example 8

In this Comparative Example, the same substrate as that used in COMPARATIVE EXAMPLE 1 was used. The same materials as those used in EXAMPLE 2 were used to prepare the same dispersion liquid for coating as that prepared in EXAMPLE 2, thereby forming an ink-receiving layer (lower layer) having a dry solid content of 5 g/m$^2$ on the substrate in the same manner as in EXAMPLE 2. Further, the same materials as those used in EXAMPLE 1 were used to prepare the same dispersion liquid for coating as that prepared in EXAMPLE 1, thereby forming an ink-receiving layer (upper layer) having a dry solid content of 10 g/m$^2$ in the same manner as in EXAMPLE 1. The surface of the ink-receiving layer was smoothed by the same method as in EXAMPLE 1. The thus-obtained recording medium of this Comparative Example was evaluated in the same manner as in EXAMPLE 1. The results are shown in Table 1.

Example 10

Paper was made by using the same beat stocks (A) and (B) as those used in EXAMPLE 1 and employing the same paper machine as that used in EXAMPLE 1 so as to give the same basis weight as in EXAMPLE 1, and the same alumina hydrate as that used in EXAMPLE 1 was used to conduct coating by the same on-machine coating method as in EXAMPLE 1 so as to give a coating weight of 0.4 g/m$^2$. A smoothing treatment was conducted in the same manner as in EXAMPLE 1 to obtain a substrate. A portion of the thus-obtained substrate, on which the alumina hydrate had been applied, was observed through an electron microscope. As a result, it was confirmed that the substrate has a surface coated part region, in which at least a surface of the fibrous material has been coated with the alumina hydrate, and voids are present as illustrated in FIG. 4. The thickness of the surface coated part region was 15 μm. The same materials as those used in EXAMPLE 1 were used to form an ink-receiving layer having the same coating weight as in EXAMPLE 1 in the same manner as in EXAMPLE 1. The surface of the ink-receiving layer was smoothed by the same method as in EXAMPLE 1. The thus-obtained recording medium of this Example was evaluated in the same manner as in EXAMPLE 1. The results are shown in Table 1.

Example 11

Paper was made by using the same beat stocks (A) and (B) as those used in EXAMPLE 1 and employing the same paper machine as that used in EXAMPLE 1 so as to give the same basis weight as in EXAMPLE 1, and the same on-machine coating liquid as that used in EXAMPLE 1 was used to apply the alumina hydrate by the same on-machine coating method as in EXAMPLE 1 so as to give a coating weight of 5 g/m$^2$. A smoothing treatment was conducted in the same manner as in EXAMPLE 1 to obtain a substrate. A portion of the thus-obtained substrate, on which the alumina hydrate had been applied, was observed through an electron microscope. As a result, it was confirmed that the substrate has a surface coated part region, in which at least a surface of the fibrous material has been coated with the alumina hydrate, and voids are present as illustrated in FIG. 4. The thickness of the surface coated part region was 40 μm. The same materials as those used in EXAMPLE 1 were used to form an ink-receiving layer having the same coating weight as in EXAMPLE 1 in the same manner as in EXAMPLE 1. The surface of the ink-receiving layer was smoothed by the same method as in EXAMPLE 1. The thus-obtained recording medium of this Example was evaluated in the same manner as in EXAMPLE 1. The results are shown in Table 1.

Comparative Example 9

A recording medium was produced in accordance with COMPARATIVE EXAMPLE 2 of Japanese Patent Application Laid-Open No. 2001-246840. The following materials were used to make paper by the same machine as that used in EXAMPLE 1 so as to give the same basis weight as in EXAMPLE 1.

| | |
|---|---|
| The same beat stocks (A) and (B) as in EXAMPLE 1 | 115 parts by mass |

-continued

| | |
|---|---|
| Filler [talc] | 4.0 parts by mass |
| Size [alkyl ketene dimmer] | 0.4 parts by mass |
| Cationic starch | 0.5 parts by mass |
| Size press [polyacrylamide] | 2.5 parts by mass. |

A material having the following composition was applied by the same machine as that used in EXAMPLE 1 so as to give the same solid content as in EXAMPLE 1. Thereafter, a smoothing treatment was conducted in the same manner as in EXAMPLE 1 to provide a recording medium of COMPARATIVE EXAMPLE 9. No ink-receiving layer was formed. The thus-obtained recording medium of this Comparative Example was evaluated in the same manner as in EXAMPLE 1. The results are shown in Table 1.

| | |
|---|---|
| Inorganic pigment [15% solution of alumina hydrate] | 115 parts by mass |
| Liquid scavenger [polyoxyethylene-polypropylene condensate] | 10 parts by mass |
| Cationic substance [benzalkonium chloride] | 2.5 parts by mass |
| Water | 125 parts by mass. |

Comparative Example 10

A recording medium was produced in accordance with EXAMPLE 1 of Japanese Patent Application Laid-Open No. 2002-21121. Paper was made by using the same beat stocks (A) and (B) as those used in EXAMPLE 1 and employing the same paper machine as that used in EXAMPLE 1 so as to give the same basis weight as in EXAMPLE 1. A coating liquid having the following composition was used in place of the on-machine coating liquid in EXAMPLE 1 to conduct on-machine coating by the same method as in EXAMPLE 1 so as to give the same coating weight as in EXAMPLE 1. A smoothing treatment was conducted in the same manner as in COMPARATIVE EXAMPLE 9 to provide a recording medium of COMPARATIVE EXAMPLE 10. No ink-receiving layer was formed. The thus-obtained recording medium of this Comparative Example was evaluated in the same manner as in EXAMPLE 1. The results are shown in Table 1.

Aqueous dispersion of alumina hydrate (the same as in EXAMPLE 1) having a solid content of 10%.

Aqueous dispersion of cationic resin (WISETEX H-90, trade name, product of Nagase Chemicals, Ltd.) having a solid content of 10%.

A mixing ratio of both dispersion liquids was 1:1 by mass.

TABLE 1

| Main components and evaluation results | | | | | | | |
|---|---|---|---|---|---|---|---|
| | Substrate | | Ink-receiving layer | Evaluation result | | | |
| | Raw material for paper | Solid content of alumina hydrate | Inorganic pigment Solid content | Curling | Cockling | Absorbency | Strike-through |
| EX. 1 | (A) + (B) | 2 g/m$^2$ | Porous silica 10 g/m$^2$ | AA | A | A | A |
| EX. 2 | (A) + (B) | 2 g/m$^2$ | Alumina hydrate 10 g/m$^2$ | A | B | A | A |
| EX. 3 | (A) + (B) | 2 g/m$^2$ | Porous silica 7 g/m$^2$ | AA | A | A | A |
| EX. 4 | (A) + (B) | 0.5 g/m$^2$ | Porous silica 10 g/m$^2$ | AA | A | A | A |

TABLE 1-continued

| Main components and evaluation results | | | | | | | |
|---|---|---|---|---|---|---|---|
| | Substrate | | Ink-receiving layer | Evaluation result | | | |
| | Raw material for paper | Solid content of alumina hydrate | Inorganic pigment Solid content | Curling | Cockling | Absorbency | Strike-through |
| EX. 5 | (A) + (B) | 4 g/m$^2$ | Porous silica 10 g/m$^2$ | AA | A | A | A |
| EX. 6 | (A) + (B) | 2 g/m$^2$ | Porous silica 10 g/m$^2$ | AA | A | A | A |
| EX. 7 | (A) + (B) | 2 g/m$^2$ | Calcium carbonate 10 g/m$^2$ | AA | A | B | A |
| EX. 8 | (A) + (B) | 2 g/m$^2$ | Magnesium carbonate 10 g/m$^2$ | AA | A | B | A |
| EX. 9 | (A) + (B) | 2 g/m$^2$ | Not used | B | B | AA | B |
| COMP. EX 1. | (A) + (B) | Not used | Not used | C | C | AA | D |
| COMP. EX 1 | (A) + (B) | Not used | Alumina hydrate 10 g/m$^2$ | B | C | A | C |
| COMP. EX. 3 | (A) + (B) | Not used | Porous silica 10 g/m$^2$ | B | C | A | C |
| COMP. EX. 4 | (A) + (B) + porous silica | Not used | Not used | C | C | AA | D |
| COMP. EX. 5 | (A) + (B) + porous silica | Not used | Alumina | C | C | A | C |
| COMP. EX. 6 | (A) + (B) + alumina hydrate | Not used | Not used | C | B | AA | D |
| COMP. EX. 7 | (A) + (B) + alumina hydrate | Not used | Silica | C | A | A | C |
| COMP. EX. 8 | (A) + (B) | Not used | Silica in upper layer/alumina in lower layer | C | C | B | B |
| EX. 10 | (A) + (B) | 0.4 g/m$^2$ | Porous silica 10 g/m$^2$ | A | B | A | A |
| EX. 11 | (A) + (B) | 5 g/m$^2$ | Porous silica 10 g/m$^2$ | A | B | B | A |
| COMP. EX. 9 | (A) + (B) | 2 g/m$^2$ | Not used | C | C | C | B |
| COMP. EX 10 | (A) + (B) | 2 g/m$^2$ | Not used | C | C | A | A |

This application claims priority from Japanese Patent Application No. 2004-163672 filed Jun. 1, 2004, which is hereby incorporated by reference herein.

What is claimed is:

1. A recording medium comprising:

a substrate composed mainly of fibrous material, and which contains no filler;

an ink-receiving layer formed on the substrate, the ink-receiving layer comprising a binder and a porous inorganic pigment, wherein the inorganic pigment is a principal component; and a surface coated part region comprising alumina hydrate, adjacent to the ink-receiving layer, wherein neither a binder nor a cationic substance other than the alumina hydrate is present, wherein a range, in which the surface coated part region exists in a thickness-wise direction of the substrate, is at least 20 μm, and wherein the alumina hydrate has an average particle diameter of from 1 nm to 50 nm.

2. The recording medium according to claim 1, wherein the alumina hydrate aggregate in the surface coated part region adheres to the surface of the fibrous material and fills in fine interspaces formed by the fibrous material intersected with or approached to each other in a state that voids formed by the fibrous material have been left without being closed.

3. The recording medium according to claim 1, wherein the porous inorganic pigment is at least one selected from among porous silica, porous calcium carbonate, porous magnesium carbonate and an alumina hydrate.

4. The recording medium according to claim 1, wherein the alumina hydrate has a boehmite structure.

5. The recording medium according to claim 1, wherein the quantity of the alumina hydrate applied to the substrate is 0.5 g/m$^2$ to 4 g/m$^2$ per one surface.

6. The recording medium according to claim 1, wherein the alumina hydrate is applied to the fibrous material by on-machine coating.

7. A process for producing the recording medium according to any one of claims 1, or 2 to 6, which comprises the steps of applying a coating liquid containing an alumina hydrate and containing neither a binder nor a cationic substance to one surface of a substrate composed mainly of a fibrous material to form a surface coated part region that the surface of the fibrous material is coated with alumina hydrate aggregate, and applying an aqueous dispersion of a porous inorganic pigment on to the surface coated part region and drying it to form an ink-receiving layer.

8. An image forming process comprising the step of applying droplets of an ink to an ink-receiving layer of a recording medium to conduct printing, wherein the recording medium according to any one of claims 1, or 2 to 6 is used as the recording medium.

9. The image forming process according to claim 8, wherein the application of the ink droplets to the recording medium is conducted by an ink-jet method that wherein fine droplets of an ink are ejected from minute orifices to apply them to the recording medium.

10. The recording medium according to claim 1, wherein the porous inorganic pigment is porous silica.

11. A recording medium comprising:

a substrate composed mainly of fibrous material, and which contains no filler;

an ink-receiving layer formed on the substrate, the ink-receiving layer comprising a binder and a porous inorganic pigment, wherein the inorganic pigment is a principal component; and a surface coated part region comprising alumina hydrate, adjacent to the ink-receiving layer, wherein the surface coated part region is formed by applying a solution containing the alumina hydrate and containing neither a binder nor a cationic substance on the substrate, wherein the ink-receiving layer is formed by coating the substrate on which the surface coated part region has been formed with a dispersion liquid containing the binder and the porous inorganic pigment, wherein a range, in which the surface coated part region exists in a thickness-wise direction of the substrate, is at least 20 μm, and wherein the alumina hydrate has an average particle diameter of from 1 nm to 50 nm.

12. A recording medium comprising:

a substrate without filler, the substrate being composed mainly of fibrous material and further comprising a coating layer of at least 20 μm, in a thickness-wise direction of the substrate, of alumina hydrate having an average particle diameter of from 1 nm to 50 nm without either a binder or a cationic substance other than the alumina hydrate being present; and an ink-receiving layer formed on the substrate adjacent to the alumina hydrate, the ink-receiving layer comprising a binder and a porous inorganic pigment.

* * * * *